US007255903B1

(12) United States Patent
Mudar et al.

(10) Patent No.: US 7,255,903 B1
(45) Date of Patent: Aug. 14, 2007

(54) PATCH BAG WITH PATCH CONTAINING HIGH AND LOW CRYSTALLINITY ETHYLENE COPOLYMERS

(75) Inventors: Kimberly Ann Mudar, Greer, SC (US); Ram Kumar Ramesh, Greenville, SC (US)

(73) Assignee: Cryovac, Inc., Duncan, SC (US)

( * ) Notice: Subject to any disclaimer, the term of this patent is extended or adjusted under 35 U.S.C. 154(b) by 702 days.

(21) Appl. No.: 09/426,827

(22) Filed: Oct. 25, 1999

(51) Int. Cl.
*B32B 27/32* (2006.01)

(52) U.S. Cl. ..... 428/34.9; 428/34.8; 428/35.1; 428/35.2; 383/113; 383/119; 383/908; 426/124; 426/127; 426/129

(58) Field of Classification Search ..... 428/35.4–35.5, 428/35.1–35.2, 35.9, 34.8–34.9, 349, 516; 383/113, 119, 908; 426/124, 127, 129
See application file for complete search history.

(56) References Cited

U.S. PATENT DOCUMENTS

| | | | | |
|---|---|---|---|---|
| 3,645,992 A | | 2/1972 | Elston | 260/80.78 |
| 4,064,296 A | | 12/1977 | Bornstein et al. | 428/35 |
| 4,278,738 A | | 7/1981 | Brax et al. | 428/515 |
| 4,640,856 A | * | 2/1987 | Ferguson et al. | 428/36 |
| 4,755,403 A | | 7/1988 | Ferguson | 428/35 |
| 4,879,430 A | | 11/1989 | Hoffman | 428/35.1 |
| 5,004,647 A | | 4/1991 | Shah | |
| 5,256,428 A | | 10/1993 | Lustig et al. | 426/127 |
| 5,272,236 A | | 12/1993 | Lai et al. | 526/348.5 |
| 5,278,272 A | | 1/1994 | Lai et al. | 526/348.5 |
| 5,283,128 A | * | 2/1994 | Wilhoit | 428/516 |
| 5,302,402 A | | 4/1994 | Dudenhoeffer et al. | 426/129 |
| 5,376,394 A | | 12/1994 | Dudenhoeffer et al. | 426/415 |
| 5,562,958 A | * | 10/1996 | Walton et al. | 428/34.9 |

(Continued)

FOREIGN PATENT DOCUMENTS

| | | |
|---|---|---|
| AU | 11228/88 | 8/1988 |

(Continued)

OTHER PUBLICATIONS

Oya et al. Feb. 1, 1991, Abstract JP 403024954A.*

(Continued)

*Primary Examiner*—Rena Dye
*Assistant Examiner*—Sow-Fun Hon
(74) *Attorney, Agent, or Firm*—Rupert B. Hurley, Jr.

(57) ABSTRACT

A patch bag has a heat-shrinkable patch adhered to a heat-shrinkable bag. The patch comprises an ethylene/alpha-olefin copolymer having a density greater than about 0.915 g/cm$^3$, this copolymer being present in the patch in an amount of at least about 5 percent, based on a total patch weight. The patch also comprises a heterogeneous ethylene/alpha-olefin copolymer having a density of less than about 0.915 g/cm$^3$, which is also present in the patch in an amount of at least about 5 percent, based on total patch weight. In addition, the two ethylene/alpha-olefin copolymers make up at least 70 percent of the total patch weight. VLDPE is a preferred heterogeneous ethylene/alpha-olefin less than 0.915 g/cc, and LLDPE is a preferred ethylene/alpha-olefin greater than 0.915 g/cc. The patch film can be selected to exhibit a total free shrink and/or bone-puncture resistance which is higher than either VLDPE or LLDPE alone. The patch film can be selected to exhibit Standard Rib Drop Test results (i.e., puncture-resistance in actual use) superior to other patch bags.

29 Claims, 4 Drawing Sheets

U.S. PATENT DOCUMENTS

| | | | | |
|---|---|---|---|---|
| 5,604,043 | A * | 2/1997 | Ahlgren | 428/518 |
| 5,707,751 | A * | 1/1998 | Garza et al. | 428/515 |
| 6,106,935 | A | 8/2000 | Lambert et al. | |
| 6,183,791 | B1 * | 2/2001 | Williams et al. | 426/129 |
| 6,254,909 | B1 * | 7/2001 | Williams et al. | 426/129 |
| 6,287,613 | B1 | 9/2001 | Childress et al. | 426/129 |
| 6,790,468 | B1 * | 9/2004 | Mize et al. | 426/129 |

FOREIGN PATENT DOCUMENTS

| | | |
|---|---|---|
| AU | 692957 | 6/1996 |
| EP | 0 512 740 A2 | 4/1992 |
| EP | 0 999 148 A1 | 6/1995 |
| WO | 90/03414 | 4/1990 |
| WO | 93/03093 | 2/1993 |
| WO | 96/00688 | 1/1996 |
| WO | 98/36903 | 8/1998 |

OTHER PUBLICATIONS

"Determination of Branching Distributions in Polyethylene and Ethylene Copolymers", Wild et al, J. Poly Science Poly. Phys. Ed., vol. 20, p. 441 (1982).

U.S. Appl. No. 60/042,664, "Patch Bag Having Seal Through Patches", U.S. Appl. No. 09/092,479.

LLDPE Properties Tied ToBranch Distribution, Plastics, Jan. '87, p. 1-31ymers, Wild et al, J. Poly Science Poly. Phys. Ed., vol. 20, p. 441 (1982).

New Family of Polyolefins from Insite Technologying, Story et al, Catalyst Consultants, Inc., May 26-28, 1993, p. 111-123.

Melting Points of Homogeneous Random Copolymers of Ethylene and 1-Alkenes, Journal of Polymer Science, vol. 25, p. 3105-3115.

Properties of Homogeneous Polyolefins, Childress, p. 1-16, © May 1994.

* cited by examiner

PATCH BAG WITH PATCH CONTAINING HIGH AND LOW CRYSTALLINITY ETHYLENE COPOLYMERS

FIELD OF THE INVENTION

The present invention relates to the packaging of products in bags made from a puncture-resistant flexible film. More particularly, the present invention relates to a patch bag, as well as processes of making patch bags.

BACKGROUND OF THE INVENTION

Various patch bags have been commercialized for the packaging of bone-in fresh meat products, especially fresh red meat products and other bone-in meat products, such as whole bone-in pork loins, etc. The patch reduces the likelihood of film puncture from protruding bones. The patch needs to exhibit good resistance to bone puncture. Optimally, the patch should also exhibit a relatively high free shrink at a relatively low temperature.

U.S. Pat. No. 4,755,403, to Ferguson, discloses a patch bag having a heat-shrinkable patch containing a blend of linear low density polyethylene blended with ethylene vinyl acetate copolymer. U.S. Pat. No. 5,302,402, to Dudenhoeffer et al., discloses the use of various polymers, including very low density polyethylene, in a non-heat-shrinkable patch for a patch bag. AU-B-40238/95 (based on Australian application40238/95, published Jun. 20, 1996) discloses the use of homogeneous ethylene/alpha-olefin copolymer in a patch for a patch bag. However, it remains desirable to provide a film which exhibits improved bone puncture resistance, especially in combination with relatively high free shrink.

SUMMARY OF THE INVENTION

The present invention is directed to a patch exhibiting a desirable combination: high free shrink in combination with improved bone puncture resistance. It has been discovered that a patch film at least 70 weight percent of which is a combination of high crystallinity ethylene/alpha-olefin copolymer (such as LLDPE) and a low crystallinity heterogeneous ethylene/alpha-olefin copolymer (such as VLDPE), provides a patch exhibiting improved bone-puncture performance over, for example, a patch utilizing a blend of linear low density polyethylene with a minor proportion of ethylene/vinyl acetate copolymer. Preferably, the patch film is made from a blend of 50 to 95 weight percent VLDPE and 5 to 50 weight percent LLDPE. Surprisingly, the bone puncture resistance of the VLDPE/LLDPE blend is greater than if either VLDPE alone or LLDPE alone are present as the bone-puncture resistant polymer. Moreover, the VLDPE-LLDPE blend, if free of ethylene/vinyl acetate copolymer and/or homogeneous ethylene/alpha-olefin copolymer, can provide the patch with a greater bone-puncture resistance while also providing relatively high free shrink at, for example 85° C. That is, even if the patch is made from a blend of VLDPE and LLDPE, if substantial amounts of ethylene/vinyl acetate copolymer and/or homogeneous ethylene/alpha-olefin copolymer are present in the VLDPE-LLDPE blend, the bone-puncture resistance is lowered. Preferably, the heat-shrinkable patch film comprises a VLDPE-LLDPE blend, with less than 30 percent of EVA or homogeneous ethylene/alpha-olefin copolymer present in the patch film.

As a first aspect, the present invention is directed to a patch bag comprising a heat-shrinkable patch adhered to a heat-shrinkable bag. The heat-shrinkable patch comprises a first heat-shrinkable film and the heat-shrinkable bag comprises a second heat-shrinkable film. The first heat-shrinkable film comprises: (A) a first component comprising an ethylene/alpha-olefin copolymer having a density greater than about 0.915 g/cm$^3$ in an amount of at least about 5 percent, based on a total weight of the first film (preferably, at least 10 or 20 or 30 or 40 or 50 or 60 or 70 or 80 or 90 or even up to 95 percent), and (B) a second component comprising a heterogeneous ethylene/alpha-olefin copolymer having a density of less than about 0.915 g/cm$^3$, wherein the second component is present in the first film in an amount of at least about 5 percent, based on a total weight of the first film (preferably, at least 10 or 20 or 30 or 40 or 50 or 60 or 70 or 80 or 90 or even up to 95 percent). The first and second components together make up at least 70 percent of the total weight of the first film (preferably, at least 75 or 80 or 85 or 90 or 95 or even up to 100 percent). The first and second components can be present in the same layer of the first heat-shrinkable film, i.e., as a blend. Alternatively, the first film can be a multilayer film, with the first and second components present in separate layers.

Preferably, the first heat shrinkable film has a layer containing a blend of the first component and the second component, wherein the first component is present in the blend in an amount of from about 5 to 95 percent, based on the weight of the layer, and the second component is present in the blend in an amount of from about 5 to 95 percent, based on the weight of the layer, and wherein the first component and the second component together make up at least 70 percent of the total weight of the layer.

In a preferred embodiment, the first film has a total free shrink, at 85° C., of at least 35 percent. Preferably, the first film and/or the second film have a total free shrink, at 85° C., of at least about 45 percent.

In a preferred embodiment, the first film comprises a blend of very low density polyethylene in an amount of from about 50 to 95 weight percent (preferably 60–95%, more preferably 70–80%), based on total blend weight, and linear low density polyethylene in an amount of from about 5 to 50 percent (preferably 5–40%, more preferably 20–30%), based on total blend weight. Optionally, the blend can further comprise homogeneous ethylene/alpha-olefin copolymer having a density of 0.915 and below, but only in any amount up to about 20 percent, based on total blend weight. Preferably, the blend is present in an amount of at least about 70 weight percent, based on layer weight (more preferably, at least 75%, 80%, 85%, 90%, or 95%), in a layer having a thickness of at least about 0.6 mil (more preferably, 0.6–5, 0.6–4, 0.6–3, 0.8–2, and 1–2 mils).

Preferably, the patch film has a total free shrink, at 85° C., of from about 50 percent to about 120 percent; more preferably, from about 50 percent to about 100 percent, and more preferably, from about 50 percent to about 80 percent. Preferably, the bag film has a total free shrink, at 85° C., of from about 50 percent to about 120 percent; more preferably, from about 50 percent to about 100 percent; and more preferably, from about 50 percent to about 80 percent.

Preferably, the patch exhibits a Standard Rib Drop Test failure rate of at most 40 percent (i.e., 40 percent or less than 40 percent, or up to and including 40 percent); more preferably, at most 35 percent; more preferably, at most 30 percent.

Preferably, the patch film is substantially free of homogeneous ethylene/alpha-olefin copolymer. That is, preferably the patch film contains no homogeneous ethylene/alpha-olefin copolymer. Alternatively and optionally, the blend can comprise homogeneous ethylene/alpha-olefin copolymer in an amount of from about 1 to about 20 percent, based on blend weight, more preferably, from about 1 to 15 percent; more preferably, from about 1 to about 10 percent; and more preferably from about 1 to about 5 percent.

Optionally, the blend can further comprise up to about 15 percent, based on total blend weight, of one or more members selected from the group consisting of slip, filler, pigment, dye, radiation stabilizer, antioxidant, fluorescence additive, antistatic agent, elastomer, and viscosity-modifying agent.

Preferably, the patch comprises very low density polyethylene in an amount of from about 70 to 80 weight percent, and linear low density polyethylene in an amount of from about 20 to 30 weight percent.

Preferably, the bag comprises a first biaxially-oriented, heat-shrinkable film comprising an outside abuse layer, an inner $O_2$-barrier layer, and an inside-sealant layer, and the patch comprises a second biaxially-oriented, heat-shrinkable film. Although the patch can be adhered to the inside surface of the bag, preferably the patch is adhered to the outside surface of the bag. Preferably the patch is adhered to the bag with an adhesive.

The patch can be a monolayer film or a multilayer film. Preferably, the patch film comprises outer layers each of which comprises the blend, and an inner layer comprising at least one member selected from the group consisting of ethylene/unsaturated ester copolymer (including ethylene/vinyl acetate, ethylene/methyl acrylate, ethylene/butyl acrylate), homogeneous ethylene/alpha-olefin copolymer, heterogeneous ethylene/alpha-olefin copolymer, ethylene/unsaturated acid copolymer (including ethylene/acrylic acid, ethylene/methacrylic acid), ionomer, and any other polymers capable of self-welding at the desired processing temperature.

Preferably, the multilayer film comprises an inner layer welded to itself and outer layers each comprising the blend. Preferably, the inner layer comprises ethylene/vinyl acetate copolymer in an amount of at least 50 percent, based on the weight of the inner layer; more preferably, at least 60 percent; more preferably, at least 70 percent; more preferably, at least 80 percent; more preferably, at least 90 percent; more preferably, 100 percent. Preferably, the ethylene/vinyl acetate copolymer comprises vinyl acetate mer in an amount of from about 3–50 weight percent, based on the weight of the ethylene/vinyl acetate copolymer; preferably, from about 15 to 40 weight percent; preferably, from about 25 to 35 weight percent.

Preferably, the multilayer film comprises at least two layers which comprise the blend. Preferably, the multilayer film has a symmetrical cross-section. Preferably, the two layers comprising the blend are the outer film layers of the patch film. In an alternative preferred embodiment, the multilayer patch film further comprises an intermediate layer which also comprises the blend. Preferably, the patch film has a symmetrical cross-section. Preferably, the patch film comprises an inner layer comprising ethylene/vinyl acetate in an amount of from about 50 to 100 percent, with the film further comprising two outer layers, each of which contains the blend. Preferably the blend comprises VLDPE in an amount of from about 70 to 80 percent (based on blend weight), and LLDPE in an amount of from about 20 to 30 percent.

Preferably, the first film has an impact strength (measured using ASTM D3763) of at least 0.5 Joules/mil (preferably at least 0.6, 0.7, 0.8, 0.9, 1.0, 1.1, 1.2, 1.3, 1.4, and 1.5 Joules /mil.).

DETAILED DESCRIPTION OF THE INVENTION

Figure 1:
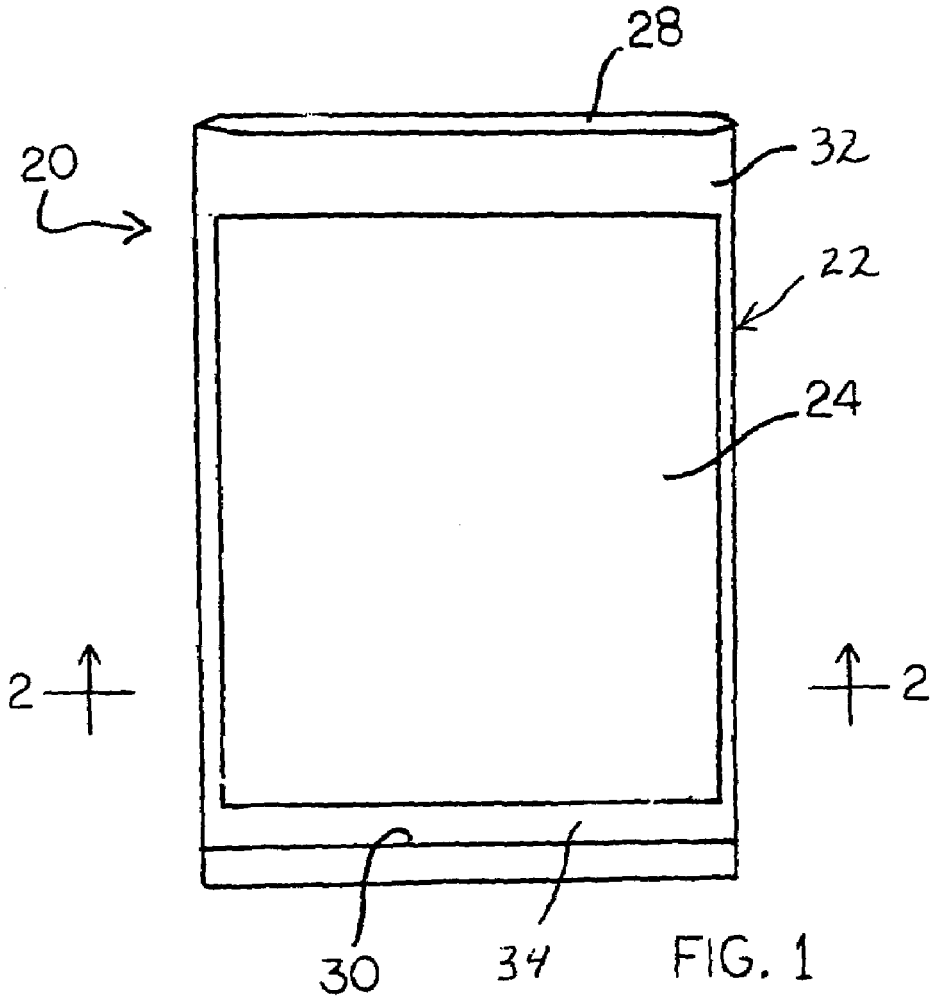
FIG. 1 illustrates a lay-flat view of an end-seal patch bag.

As used herein, the term "bag" is inclusive of L-seal bags, side-seal bags, backseamed bags, and pouches. An L-seal bag has an open top, a bottom seal, one side-seal along a first side edge, and a seamless (i.e., folded, unsealed) second side edge. A side-seal bag has a an open top, a seamless bottom edge, with each of its two side edges having a seal therealong. Although seals along the side and/or bottom edges can be at the very edge itself, (i.e., seals of a type commonly referred to as "trim seals"), preferably the seals are spaced inward (preferably ¼ to ½ inch, more or less) from the bag side edges, and preferably are made using a impulse-type heat sealing apparatus, which utilizes a bar which is quickly heated and then quickly cooled. A backseamed bag is a bag having an open top, a seal running the length of the bag in which the bag film is either fin-sealed or lap-sealed, two seamless side edges, and a bottom seal along a bottom edge of the bag.

As used herein, the phrases "heat-shrinkable," "heat-shrink" and the like refer to the tendency of a film, generally an oriented film, to shrink upon the application of heat, i.e., to contract upon being heated, such that the size (area) of the film decreases if the film is not restrained when heated. Likewise, the tension of a heat-shrinkable film increases upon the application of heat if the film is restrained from shrinking. As a corollary, the phrase "heat-contracted" refers to a heat-shrinkable film, or a portion thereof, which has been exposed to heat such that the film or portion thereof is in a heat-shrunken state, i.e., reduced in size (unrestrained) or under increased tension (restrained). Preferably, the heat shrinkable film has a total free shrink (i.e., machine direction plus transverse direction), as measured by ASTM D 2732, of at least as 5 percent at 185° C., more preferably at least 7 percent, still more preferably, at least 10 percent, and, yet still more preferably, at least 20 percent.

As used herein, the phrase "heterogeneous polymer" refers to polymerization reaction products of relatively wide variation in molecular weight and relatively wide variation in composition distribution, i.e., typical polymers prepared, for example, using conventional Ziegler-Natta catalysts. Heterogeneous copolymers typically contain a relatively wide variety of chain lengths and comonomer percentages.

As used herein, the phrase "homogeneous polymer" refers to polymerization reaction products of relatively narrow molecular weight distribution and relatively narrow composition distribution. Homogeneous polymers are useful in various layers of the multilayer film used in the present invention. Homogeneous polymers are structurally different from heterogeneous polymers, in that homogeneous polymers exhibit a relatively even sequencing of comonomers within a chain, a mirroring of sequence distribution in all chains, and a similarity of length of all chains, i.e., a narrower molecular weight distribution. Furthermore, homogeneous polymers are typically prepared using metallocene, or other single-site type catalysis, rather than using Ziegler Natta catalysts.

More particularly, homogeneous ethylene/alpha-olefin copolymers may be characterized by one or more processes known to those of skill in the art, such as molecular weight distribution (Mw/Mn), Mz/Mn, composition distribution breadth index (CDBI), and narrow melting point range and single melt point behavior. The molecular weight distribution (Mw/Mn), also known as polydispersity, may be determined by gel permeation chromatography. The homogeneous ethylene/alpha-olefin copolymers useful in this invention generally has (Mw/Mn) of less than 2.7; preferably from about 1.9 to 2.5; more preferably, from about 1.9 to 2.3. The composition distribution breadth index (CDBI) of such homogeneous ethylene/alpha-olefin copolymers will generally be greater than about 70 percent. The CDBI is defined as the weight percent of the copolymer molecules having a comonomer content within 50 percent (i.e., plus or minus 50%) of the median total molar comonomer content. The CDBI of linear polyethylene, which does not contain a comonomer, is defined to be 100%. The Composition Distribution Breadth Index (CDBI) is determined via the technique of Temperature Rising Elution Fractionation (TREF). CDBI determination clearly distinguishes the homogeneous copolymers (narrow composition distribution as assessed by CDBI values generally above 70%) from VLDPEs available commercially which generally have a broad composition distribution as assessed by CDBI values generally less than 55%. The CDBI of a copolymer is readily calculated from data obtained from techniques known in the art, such as, for example, temperature rising elution fractionation as described, for example, in Wild et. al., J. Poly. Sci. Poly. Phys. Ed., Vol. 20, p. 441 (1982). Preferably, homogeneous ethylene/alpha-olefin copolymers have a CDBI greater than about 70%, i.e., a CDBI of from about 70% to 99%. In general, the homogeneous ethylene/alpha-olefin copolymers in the patch bag of the present invention also exhibit a relatively narrow melting point range, in comparison with "heterogeneous copolymers", i.e., polymers having a CDBI of less than 55%. Preferably, the homogeneous ethylene/alpha-olefin copolymers exhibit an essentially singular melting point characteristic, with a peak melting point (Tm), as determined by Differential Scanning Calorimetry (DSC), of from about 60° C. to 110° C. Preferably the homogeneous copolymer has a DSC peak Tm of from about 80° C. to 100° C. As used herein, the phrase "essentially single melting point" means that at least about 80%, by weight, of the material corresponds to a single Tm peak at a temperature within the range of from about 60° C. to 1110° C., and essentially no substantial fraction of the material has a peak melting point in excess of about 115° C., as determined by DSC analysis. DSC measurements are made on a Perkin Elmer System 7 Thermal Analysis System. Melting information reported are second melting data, i.e., the sample is heated at a programmed rate of 10° C./min. to a temperature below its critical range. The sample is then reheated (2nd melting) at a programmed rate of 10° C./min. The presence of higher melting peaks is detrimental to film properties such as haze, and compromises the chances for meaningful reduction in the seal initiation temperature of the final film.

A homogeneous ethylene/alpha-olefin copolymer can, in general, be prepared by the copolymerization of ethylene and any one or more alpha-olefin. Preferably, the alpha-olefin is a $C_3$–$C_{20}$ alpha-monoolefin, more preferably, a $C_4$–$C_{12}$alpha-monoolefin, still more preferably, a $C_4$–$C_8$ alpha-monoolefin. Still more preferably, the alpha-olefin comprises at least one member selected from the group consisting of butene-1, hexene-1, and octene-1, i.e., 1-butene, 1-hexene, and 1-octene, respectively. Most preferably, the alpha-olefin comprises octene-1, and/or a blend of hexene-1 and butene-1.

Processes for preparing and using homogeneous polymers are disclosed in U.S. Pat. No. 5,206,075, U.S. Pat. No. 5,241,031, and PCT International Application WO 93/03093, each of which is hereby incorporated by reference thereto, in its entirety. Further details regarding the production and use of homogeneous ethylene/alpha-olefin copolymers are disclosed in PCT International Publication Number WO 90/03414, and PCT International Publication Number WO 93/03093, both of which designate Exxon Chemical Patents, Inc. as the Applicant, and both of which are hereby incorporated by reference thereto, in their respective entireties.

Still another genus of homogeneous ethylene/alpha-olefin copolymers is disclosed in U.S. Pat. No. 5,272,236, to LAI, et. al., and U.S. Pat. No. 5,278,272, to LAI, et. al., both of which are hereby incorporated by reference thereto, in their respective entireties. Each of these patents disclose substantially linear homogeneous long chain branched ethylene/alpha-olefin copolymers produced and marketed by The Dow Chemical Company.

As used herein, the phrase "ethylene/alpha-olefin copolymer", and "ethylene/alpha-olefin copolymer", refer to such materials as linear low density polyethylene (LLDPE), and very low and ultra low density polyethylene (VLDPE and ULDPE); and homogeneous polymers such as metallocene catalyzed polymers such as EXACT® resins obtainable from the Exxon Chemical Company, and TAFMER® resins obtainable from the Mitsui Petrochemical Corporation. All these materials generally include copolymers of ethylene with one or more comonomers selected from $C_4$ to $C_{10}$ alpha-olefin such as butene-1 (i.e., 1-butene), hexene-1, octene-1, etc. in which the molecules of the copolymers comprise long chains with relatively few side chain branches or cross-linked structures. This molecular structure is to be contrasted with conventional low or medium density polyethylenes which are more highly branched than their respective counterparts. The heterogeneous ethylene/alpha-olefins commonly known as LLDPE have a density usually in the range of from about 0.91 grams per cubic centimeter to about 0.94 grams per cubic centimeter. Other ethylene/alpha-olefin copolymers, such as the long chain branched homogeneous ethylene/alpha-olefin copolymers available from the Dow Chemical Company, known as AFFINITY® resins, are also included as another type of homogeneous ethylene/alpha-olefin copolymer useful in the present invention.

In general, the ethylene/alpha-olefin copolymer comprises a copolymer resulting from the copolymerization of from about 80 to 99 weight percent ethylene and from 1 to 20 weight percent alpha-olefin. Preferably, the ethylene/alpha-olefin copolymer comprises a copolymer resulting from the copolymerization of from about 85 to 95 weight percent ethylene and from 5 to 15 weight percent alpha-olefin.

As used herein, the phrase "very low density polyethylene" refers to heterogeneous ethylene/alpha-olefin copolymers having a density of 0.915 g/cc and below, preferably from about 0.88 to 0.915 g/cc. As used herein, the phrase "linear low density polyethylene" refers to, and is inclusive of, both heterogeneous and homogeneous ethylene/alpha-olefin copolymers having a density of at least 0.915 g/cc, preferably from 0.916 to 0.94 g/cc.

As used herein, the phrases "inner layer" and "internal layer" refer to any layer, of a multilayer film, having both of its principal surfaces directly adhered to another layer of the film.

As used herein, the phrase "outer layer" refers to any film layer of film having less than two of its principal surfaces directly adhered to another layer of the film. The phrase is inclusive of monolayer and multilayer films. In multilayer films, there are two outer layers, each of which has a principal surface adhered to only one other layer of the multilayer film. In monolayer films, there is only one layer, which, of course, is an outer layer in that neither of its two principal surfaces are adhered to another layer of the film.

As used herein, the phrase "inside layer" refers to the outer layer of a multilayer film packaging a product, which is closest to the product, relative to the other layers of the multilayer film.

As used herein, the phrase "outside layer" refers to the outer layer, of a multilayer film packaging a product, which is furthest from the product relative to the other layers of the multilayer film. Likewise, the "outside surface" of a bag is the surface away from the product being packaged within the bag.

As used herein, the term "adhered" is inclusive of films which are directly adhered to one another using a heat seal or other means, as well as films which are adhered to one another using an adhesive which is between the two films.

Although the films used in the patch bag according to the present invention can be monolayer films or multilayer films, the patch bag comprises at least two films laminated together. Preferably, the patch bag is comprised of films which together comprise a total of from 2 to 20 layers, more preferably, from 2 to 12 layers; and still more preferably, from 4 to 12 layers. In general, the multilayer film(s) used in the present invention can have any total thickness desired, so long as the film provides the desired properties for the particular packaging operation in which the film is used, e.g. abuse-resistance (especially puncture-resistance), modulus, seal strength, optics, etc.

Figure 2:
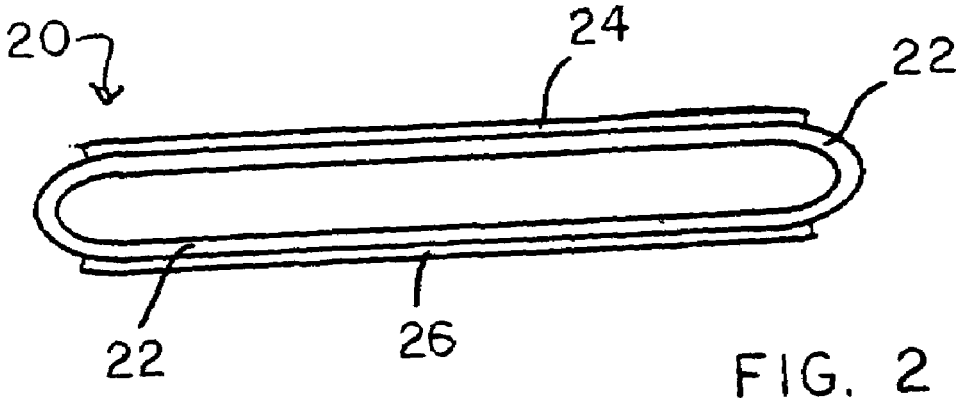
FIG. 2 illustrates a cross-sectional view of the patch bag of FIG. 1, taken through section 2—2 thereof

FIG. 1 is a lay-flat view of a preferred end-seal patch bag 20, in a lay-flat position, this patch bag being in accordance with the present invention; FIG. 2 is a transverse cross-sectional view of patch bag 20, taken through section 2—2 of FIG. 1. Viewing FIGS. 1 and 2 together, patch bag 20 comprises bag 22, first patch 24, second patch 26, open top 28, and end-seal 30.

Those portions of bag 22 to which patches 24 and 26 are adhered are "covered", i.e., protected, by patches 24 and 26, respectively. Upper and lower end portions 32 and 34 (respectively) of bag 22 are preferably not covered by patch 24, for ease in producing end-seal 26, which is preferably made before a product is placed in the bag, as well as a top-seal (not illustrated) which is preferably made after a product is placed in the bag. Unless performed properly, heat-sealing through bag and patch 22 and patch 24 together can result in burn-through and/or a weaker seal. For a special process of sealing through the patch and bag together, see U.S. Ser. No. 60/042,664, in the name of DePoorter et al, entitled "PATCH BAG HAVING SEAL THROUGH PATCHES," filed Apr. 4, 1997, the entirety of which is hereby incorporated by reference thereto.

Figure 3:
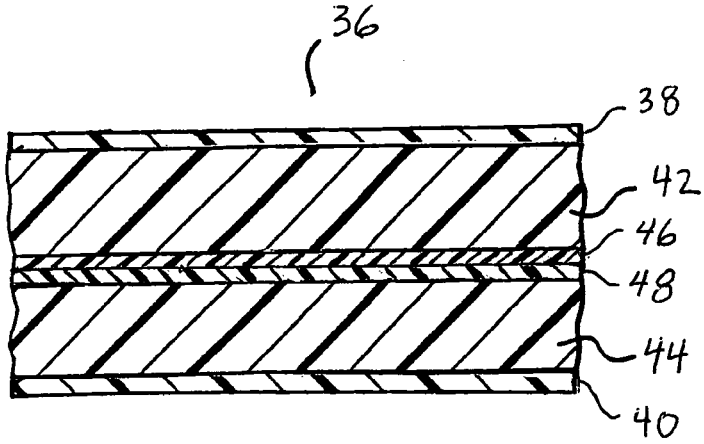
FIG. 3 illustrates a cross-sectional view of a multilayer film for use in a preferred patch in accordance with the present invention.

FIG. 3 illustrates a schematic view of a preferred film for use as the patch film in, for example, the patch bag illustrated in FIGS. 1 and 2. In FIG. 3, multilayer film 36 has outer layers 38 and 40, intermediate layers 42 and 44, and self-weld layers 46 and 48.

Figure 4:
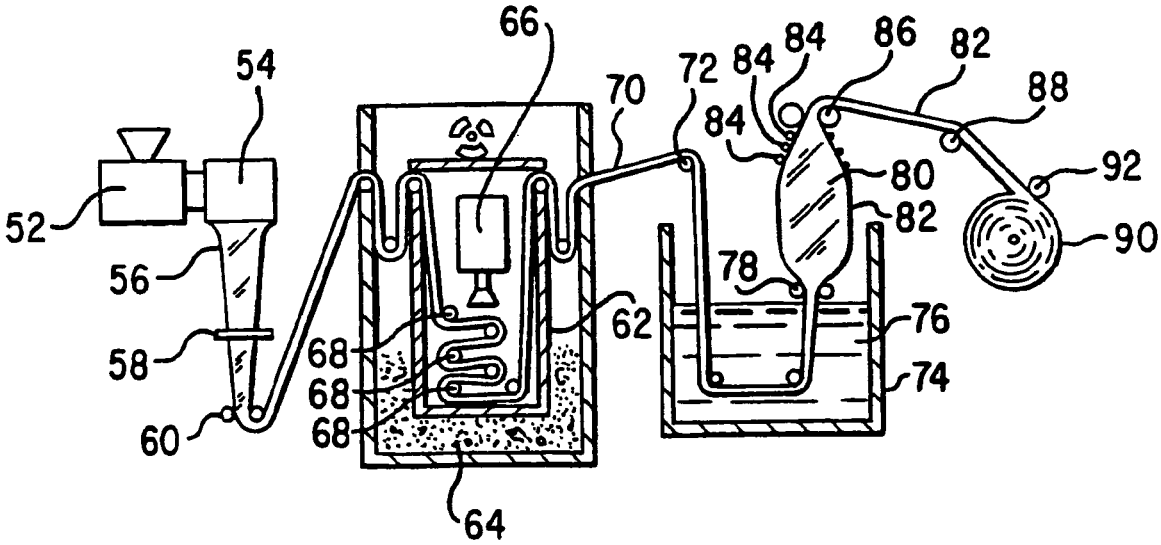
FIG. 4 illustrates a schematic view of a preferred process for making the multilayer film of FIG. 3.

FIG. 4 illustrates a schematic of a preferred process for producing the multilayer film for use in the patch in the patch bag of the present invention, e.g. the patch film illustrated in FIG. 3. In the process illustrated in FIG. 4, solid polymer beads (not illustrated) are fed to a plurality of extruders 52 (for simplicity, only one extruder is illustrated). Inside extruders 52, the polymer beads are forwarded, melted, and degassed, following which the resulting bubble-free melt is forwarded into die head 54, and extruded through annular die, resulting in tubing 56 which is 5–40 mils thick, more preferably 20–30 mils thick, still more preferably, about 25 mils thick.

After cooling or quenching by water spray from cooling ring 58, tubing 56 is collapsed by pinch rolls 60, and is thereafter fed through irradiation vault 62 surrounded by shielding 64, where tubing 56 is irradiated with high energy electrons (i.e., ionizing radiation) from iron core transformer accelerator 66. Tubing 56 is guided through irradiation vault 62 on rolls 68. Preferably, the irradiation of tubing 56 is at a level of from about 10 megarads ("MR").

After irradiation, irradiated tubing 70 is directed over guide roll 72, after which irradiated tubing 70 passes into hot water bath tank 74 containing hot water 76. The now collapsed irradiated tubing 70 is submersed in the hot water for a retention time of at least about 5 seconds, i.e., for a time period in order to bring the film up to the desired temperature, following which supplemental heating means (not illustrated) including a plurality of steam rolls around which irradiated tubing 70 is partially wound, and optional hot air blowers, elevate the temperature of irradiated tubing 70 to a desired orientation temperature of from about 240° F.–250° F. A preferred means for heating irradiated tubing 70 is with an infrared oven (not illustrated), by exposure to infrared radiation for about 3 seconds, also bringing the tubing up to about 240–250° F. Thereafter, irradiated film 70 is directed through nip rolls 78, and bubble 80 is blown, thereby transversely stretching irradiated tubing 70. Furthermore, while being blown, i.e., transversely stretched, irradiated film 70 is drawn (i.e., in the longitudinal direction) between nip rolls 78 and nip rolls 86, as nip rolls 86 have a higher surface speed than the surface speed of nip rolls 78. As a result of the transverse stretching and longitudinal drawing, irradiated, biaxially-oriented, blown tubing film 82 is produced, this blown tubing preferably having been both stretched at a ratio of from about 1:1.5–1:6, and drawn at a ratio of from about 1:1.5–1:6. More preferably, the stretching and drawing are each performed at a ratio of from about 1:2–1:4. The result is a biaxial orientation of from about 1:2.25–1:36, more preferably, 1:4–1:16. While bubble 80 is maintained between pinch rolls 78 and 86, blown tubing 82 is collapsed by rolls 84, and thereafter conveyed through nip rolls 86 and across guide roll 88, and then rolled onto wind-up roller 90. Idler roll 92 assures a good wind-up.

Preferably, the stock film from which the bag is formed has a total thickness of from about 1.5 to 5 mils; more preferably, about 2.5 mils. Preferably the stock film from which the bag is formed is a multilayer film having from 3 to 7 layers; more preferably, 4 layers.

Figure 5:
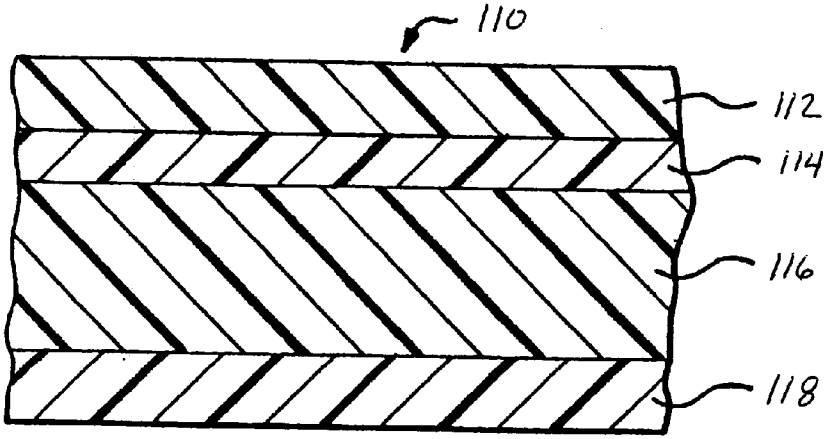
FIG. 5 illustrates a cross-sectional view of a multilayer film for use in a preferred bag in accordance with the present invention.

FIG. 5 illustrates a cross-sectional view of preferred multilayer film 110 for use as the tubing film stock from which bag 22 is formed. Multilayer film 110 has a physical structure, in terms of number of layers, layer thickness, and layer arrangement and orientation in the patch bag, and a chemical composition in terms of the various polymers, etc. present in each of the layers, as set forth in Table I, below.

TABLE I

| Layer Designation | Layer Function | Layer Chemical Identity | Layer Thickness (mils) |
|---|---|---|---|
| 112 | Outside and abuse layer | 90% EVA #1<br>10% HDPE #1 | 0.58 |
| 114 | $O_2$-Barrier layer | 96% VDC/MA #1;<br>2% epoxidized soybean oil;<br>and 2% bu-A/MA/bu-MA terpolymer | 0.19 |
| 116 | Puncture-resistant | 85% LLDPE #1 & 15% EBA #1 | 1.15 |
| 118 | Sealant and inside layer | 80% SSPE #1<br>20% LLDPE #2 | 0.48 |

LLDPE #1 was DOWLEX® 2045 linear low density polyethylene, obtained from the Dow Chemical Company of Midland, Mich. LLDPE #2 was ESCORENE® LL3003.32 linear low density polyethylene, obtained from Exxon Chemical Company of Baytown, Tex. SSPE#1 was AFFINITY® metallocene-catalyzed ethylene/octene copolymer, obtained from The Dow Chemical Company, of Midland, Mich. HDPE #1 was Fortiflex® T60-500-119 high density polyethylene, obtained from Solvay Polymers, of Deer Park, Tex. EVA No. 1 was ESCORENE® LD318.92 ethylene/vinyl acetate copolymer having a melt index of 2.0, a density of 0.930 g/cc, and a vinyl acetate mer content of 9 percent, this resin being obtained from the Exxon Chemical Company. EBA No. 1 was SP1802 ethylene/butyl acrylate copolymer containing 18% butyl acrylate, obtained from Chevron Chemical Company, of Houston, Tex. VDC/MA No. 1 was SARAN® MA-134 vinylidene chloride/methyl acrylate copolymer, obtained from the Dow Chemical Company. The epoxidized soybean oil was PLAS-CHEK® 775 epoxidized soybean oil, obtained from the Bedford Chemical Division of Ferro Corporation, of Walton Hills, Ohio. Bu-A/MA/bu-MA terpolymer was METABLEN® L-1000 butyl acrylate/methyl methacrylate/butyl methacrylate terpolymer, obtained from Elf Atochem North America, Inc., of 2000 Market Street, Philadelphia, Pa. 19103.

Figure 6:
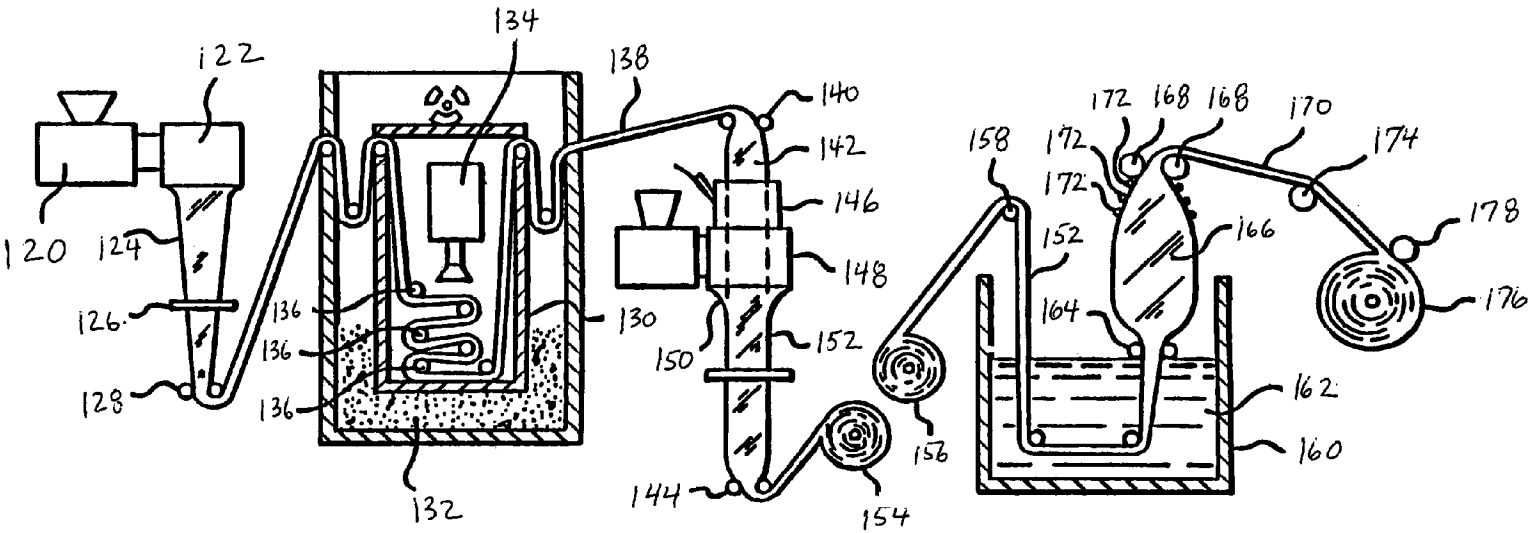
FIG. 6 illustrates a schematic view of a preferred process for making the multilayer film of FIG. 5.

FIG. 6 illustrates a schematic of a preferred process for producing the multilayer film of FIG. 5. In the process illustrated in FIG. 6, solid polymer beads (not illustrated) are fed to a plurality of extruders 120 (for simplicity, only one extruder is illustrated). Inside extruders 120, the polymer beads are forwarded, melted, and degassed, following which the resulting bubble-free melt is forwarded into die head 122, and extruded through an annular die, resulting in tubing 124 which is 10 to 30 mils thick, more preferably 15 to 25 mils thick.

After cooling or quenching by water spray from cooling ring 126, tubing 124 is collapsed by pinch rolls 128, and is thereafter fed through irradiation vault 130 surrounded by shielding 132, where tubing 124 is irradiated with high energy electrons (i.e., ionizing radiation) from iron core transformer accelerator 134. Tubing 124 is guided through irradiation vault 130 on rolls 136. Preferably, tubing 124 is irradiated to a level of about 4.5 MR.

After irradiation, irradiated tubing 138 is directed through nip rolls 140, following which tubing 138 is slightly inflated, resulting in trapped bubble 142. However, at trapped bubble 142, the tubing is not significantly drawn longitudinally, as the surface speed of nip rolls 144 are about the same speed as nip rolls 140. Furthermore, irradiated tubing 138 is inflated only enough to provide a substantially circular tubing without significant transverse orientation, i.e., without stretching.

Slightly inflated, irradiated tubing 138 is passed through vacuum chamber 146, and thereafter forwarded through coating die 148. Second tubular film 150 is melt extruded from coating die 148 and coated onto slightly inflated, irradiated tube 138, to form two-ply tubular film 152. Second tubular film 150 preferably comprises an $O_2$-barrier layer, which does not pass through the ionizing radiation. Further details of the above-described coating step are generally as set forth in U.S. Pat. No. 4,278,738, to BRAX et. Al., which is hereby incorporated by reference thereto, in its entirety.

After irradiation and coating, two-ply tubing film 152 is wound up onto windup roll 154. Thereafter, windup roll 154 is removed and installed as unwind roll 156, on a second stage in the process of making the tubing film as ultimately desired. Two-ply tubular film 152, from unwind roll 156, is unwound and passed over guide roll 158, after which two-ply tubular film 152 passes into hot water bath tank 160 containing hot water 162. The now collapsed, irradiated, coated tubular film 152 is submersed in hot water 162 (having a temperature of about 210° F.) for a retention time of at least about 5 seconds, i.e., for a time period in order to bring the film up to the desired temperature for biaxial orientation. Thereafter, irradiated tubular film 152 is directed through nip rolls 164, and bubble 166 is blown, thereby transversely stretching tubular film 152. Furthermore, while being blown, i.e., transversely stretched, nip rolls 168 draw tubular film 152 in the longitudinal direction, as nip rolls 168 have a surface speed higher than the surface speed of nip rolls 164. As a result of the transverse stretching and longitudinal drawing, irradiated, coated biaxially-oriented blown tubing film 170 is produced, this blown tubing preferably having been both stretched in a ratio of from about 1:1.5–1:6, and drawn in a ratio of from about 1:1.5–1:6. More preferably, the stretching and drawing are each performed a ratio of from about 1:2–1:4. The result is a biaxial orientation of from about 1:2.25–1:36, more preferably, 1:4–1:16. While bubble 166 is maintained between pinch rolls 164 and 168, blown tubing film 170 is collapsed by rolls 172, and thereafter conveyed through nip rolls 168 and across guide roll 174, and then rolled onto wind-up roll 176. Idler roll 178 assures a good wind-up.

Figure 7:
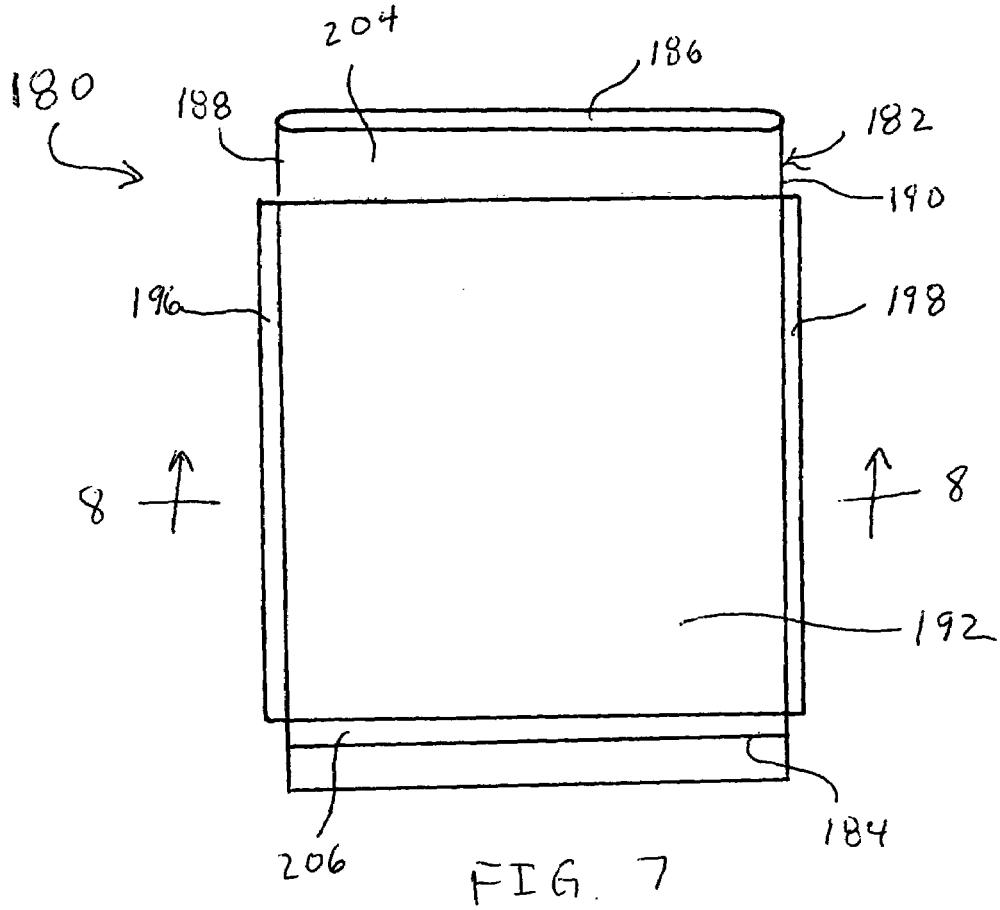
FIG. 7 illustrates a lay-flat view of a "wide-patch" patch bag used in the Standard Rib Drop Test.
Figure 8:
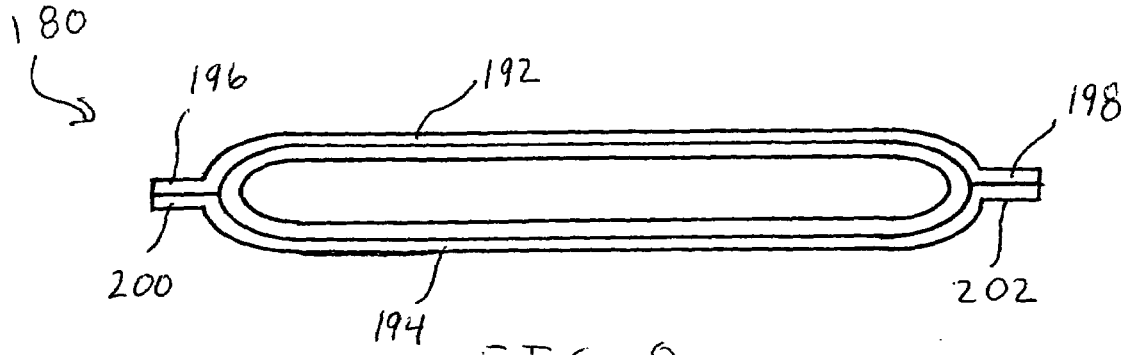
FIG. 8 illustrates a cross-sectional view of the patch bag of FIG. 7, taken through section 8—8 thereof.

FIG. 7 is a schematic illustration of another preferred patch bag 180 substantially in its lay-flat configuration, this patch bag being a "wide patch" patch bag. This is the bag used in the Standard Rib Drop Test set forth below. FIG. 8 illustrates a cross-sectional view of patch bag 180 taken through section 8—8 of FIG. 7. Viewing both FIGS. 7 and 8, patch bag 180 comprises bag 182 having end-seal 184, open top 186, first side-edge 188, and second side-edge 190. Adhered to the outside surface of bag 180 are first patch 192 and second patch 194. First patch 192 has first overhang 196, which overhangs first side edge 188, and second overhang 198, which overhangs second side edge 190. Second patch 194 has third overhang 200, which overhangs first side edge 188 and is adhered to first overhang 196, and fourth overhang 202 which overhangs second side edge 190 and is adhered to second overhang 198. Thus, over the length of bag 182 on which first patch 192 and second patch 194 are adhered, the full width of bag 182 is "covered" by the combination of patches 192 and 194, i.e., together, patches 192 and 194 constitute a "full width" coverage of bag 182. End portions 204 and 206 of bag 182 are not covered by patches 192 and 194, in order that strong seals can be made through bag 182, without having to seal through bag both of patches 192 and/or 194.

The polymer components used to fabricate multilayer films according to the present invention may also contain appropriate amounts of other additives normally included in such compositions. These include antiblocking agents (such as talc), slip agents (such as fatty acid amides), fillers, pigments and dyes, radiation stabilizers (including antioxidants), fluorescence additives (including a material which fluoresces under ultraviolet radiation), antistatic agents, elastomers, viscosity-modifying substances (such as fluoropolymer processing aids) and the like additives known to those of skill in the art of packaging films.

The multilayer films used to make the patch bag of the present invention are preferably irradiated to induce crosslinking, as well as corona treated to roughen the surface of the films which are to be adhered to one another. In the irradiation process, the film is subjected to an energetic radiation treatment, such as corona discharge, plasma, flame, ultraviolet, X-ray, gamma ray, beta ray, and high energy electron treatment, which induce cross-linking between molecules of the irradiated material. The irradiation of polymeric films is disclosed in U.S. Pat. No. 4,064,296, to BORNSTEIN, et. Al., which is hereby incorporated in its entirety, by reference thereto. BORNSTEIN, et. Al. Discloses the use of ionizing radiation for crosslinking the polymer present in the film.

Radiation dosages are referred to herein in terms of the radiation unit "RAD", with one million RADS, also known as a megarad, being designated as "MR", or, in terms of the radiation unit kiloGray (kGy), with 10 kiloGray representing 1 MR, as is known to those of skill in the art. A suitable radiation dosage of high energy electrons is in the range of up to about 16 to 166 kGy, more preferably about 40 to 90 kGy, and still more preferably, 55 to 75 kGy. Preferably, irradiation is carried out by an electron accelerator and the dosage level is determined by standard dosimetry processes. Other accelerators such as a van der Graaf or resonating transformer may be used. The radiation is not limited to electrons from an accelerator since any ionizing radiation may be used.

As used herein, the phrases "corona treatment" and "corona discharge treatment" refer to subjecting the surfaces of thermoplastic materials, such as polyolefins, to corona discharge, i.e., the ionization of a gas such as air in close proximity to a film surface, the ionization initiated by a high voltage passed through a nearby electrode, and causing oxidation and other changes to the film surface, such as surface roughness.

Corona treatment of polymeric materials is disclosed in U.S. Pat. No. 4,120,716, to BONET, issued Oct. 17, 1978, herein incorporated in its entirety by reference thereto, discloses improved adherence characteristics of the surface of polyethylene by corona treatment, to oxidize the polyethylene surface. U.S. Pat. No. 4,879,430, to HOFFMAN, also hereby incorporated in its entirety by reference thereto, discloses the use of corona discharge for the treatment of plastic webs for use in meat cook-in packaging, with the corona treatment of the inside surface of the web to increase the adhesion of the meat to the adhesion of the meat to the proteinaceous material. Although corona treatment is a preferred treatment of the multilayer films used to make the patch bag of the present invention, plasma treatment of the film may also be used.

Laminating the patch to the bag can be accomplished by a variety of methods, including the use of an adhesive, corona treatment, or even heat sealing. Adhesives are the preferred means for accomplishing the lamination. Examples of suitable types of adhesives include thermoplastic acrylic emulsions, solvent based adhesives and high solids adhesives, ultraviolet-cured adhesive, and electron-beam cured adhesive, as known to those of skill in the art. A preferred adhesive is a thermoplastic acrylic emulsion known as RHOPLEX® N619( thermoplastic acrylic emulsion, obtained from the Rohm & Haas Company, at Dominion Plaza Suite 545, 17304 Preston Rd., Dallas, Tex. 75252, Rohm & Haas having headquarters at 7th floor, Independence Mall West, Philadelphia, Pa. 19105.

Turning next to preferred embodiments of the film from which the patch is made, while the first component can be a homogeneous ethylene/alpha-olefin copolymer or a heterogeneous ethylene/alpha-olefin copolymer, preferably the first component comprises a heterogeneous ethylene/alpha-olefin copolymer. Preferably, the first component comprises an ethylene/alpha-olefin copolymer having a density of at least about 0.915 g/cm$^3$; more preferably, greater than about 0.916, more preferably, greater than about 0.917; more preferably, greater than about 0.918; more preferably, greater than about 0.919; more preferably, greater than about 0.920. Preferably, the first component comprises an ethylene/alpha-olefin copolymer having a density of less than about 0.960 g/cm$^3$; more preferably, less than about 0.940; more preferably, less than about 0.935; more preferably, less than about 0.930; more preferably, less than about 0.928; and more preferably, less than about 0.926.

Although the first and second components are preferably present as a blend, they can alternatively be present in separate film layers. Preferably, the first film comprises the first component in an amount less than about 90%, based on the weight of the first film; more preferably, less than about 80%; more preferably, less than about 70%; more preferably, less than about 60%; more preferably, less than about 50%. Preferred ranges include 10–90%, 10–50%, 10–40%, and 20–30%.

Preferably, the first component comprises an ethylene/alpha-olefin copolymer which is a copolymer of ethylene and at least one member selected from the group consisting of $C_3$–$C_{20}$ olefin; more preferably, a $C_3$–$C_{20}$ alpha-monoolefin, more preferably, a $C_4$–$C_{12}$ alpha-monoolefin, still more preferably, a $C_4$–$C_8$ alpha-monoolefin. Still more preferably, the alpha-olefin comprises at least one member selected from the group consisting of butene-1, hexene-1, and octene-1, i.e., 1-butene, 1-hexene, and 1-octene, respectively. Preferably, the alpha-olefin comprises octene-1, and/or a blend of hexene-1 and butene-1. The first component can comprise an ethylene/alpha-olefin copolymer containing ethylene mer and mers of at least two different comonomers in addition to ethylene mer.

Preferably, the second component comprises a heterogeneous ethylene/alpha-olefin copolymer having a density of less than about 0.915 g/cm$^3$. In one embodiment, the ethylene/alpha-olefin copolymer has a density of less than 0.914; more preferably, less than about 0.913; more preferably, less than about 0.910; more preferably, less than about 0.908; more preferably, less than about 0.906; more preferably, less than about 0.904; more preferably, less than about 0.902; more preferably, less than about 0.900; more preferably, less than about 0.898; more preferably, less than about 0.895; more preferably, less than about 0.890; more preferably, less than about 0.885; and more preferably, less than about 0.88. Preferred density ranges include 0.88 to 0.915, 0.89 to 0.915, 0.90 to 0.915, 0.900 to 0.912, and 0.900 to 0.910 g/cc. Some examples of resins that can be used as the second component include various ATTANE® polymers from Dow Chemical (e.g., ATTANE® 4203) and polymers referred to as ULDPE/VLDPE, made by Union Carbide Chemicals and Plastics Company (e.g., DFDA 1137).

Preferably, the second component contains an ethylene/alpha-olefin in which the alpha-olefin comonomer comprises at least one comonomer selected from the group consisting of $C_3$–$C_{20}$ olefin; more preferably, $C_3$–$C_{20}$ alpha-monoolefin, more preferably, $C_4$–$C_{12}$ alpha-monoolefin, still more preferably, $C_4$–$C_8$ alpha-monoolefin. Preferably, the alpha-olefin comprises at least one member selected from the group consisting of butene-1, hexene-1, and octene-1, i.e., 1-butene, 1-hexene, and 1-octene, respectively. Preferably, the alpha-olefin comprises octene-1, and/or a blend of hexene-1 and butene-1. The second component can comprise an ethylene/alpha-olefin copolymer consisting of two or more comonomers.

Preferably, the second component is present in the first film in an amount of from about 5 to 95 weight percent, preferably 30–95, 50–90, 60–90, and 70–80 weight percent.

In a preferred embodiment, the first film comprises a first layer which comprises a blend of the first component and the second component, each having a chemical composition as described supra. In one embodiment, the first layer comprises the first component in an amount of at least about 5 percent, based on total blend weight. Preferably, the blend comprises the first component in an amount of from about 5–70%, more preferably 10–50%, more preferably 10–40%, and more preferably 20–30%. In this same embodiment, the first layer preferably comprises the second component in an amount of at least about 5 percent, based on total blend weight. Preferably, the blend comprises the second component in an amount of from about 30–95%, more preferably 50–90% percent, more preferably 60–90%, more preferably 70–80%.

While the first layer can be an outer layer or an inner layer, preferably, it is an outer layer. The first layer as described above preferably has a thickness of from about 0.001 to about 0.2 mm; more preferably, from about 0.003 mm to about 0.2 mm; more preferably, from about 0.005 mm to about 0.15 mm; more preferably, from about 0.007 to about 0.15 mm; more preferably, from about 0.01 mm to about 0.15 mm; more preferably, from about 0.015 mm to about 0.15 mm; more preferably, from about 0.02 mm to about 0.10 mm; more preferably, from about 0.03 mm to about 0.08 mm; more preferably, from about 0.04 mm to about 0.08 mm; and most preferably from about 0.04 mm to about 0.06 mm. Generally, the thickness of the first layer is from about 1 to about 100%, based on the total thickness of the multilayer film; more preferably, from about 5 to about 100%; more preferably, from about 10 to about 40%; more preferably, from about 20 to about 100%; and more preferably, from about 25% to about 100% preferably, at least about 20%; more preferably, at least about 30%; more preferably, at least about 40%; more prefer ably, at least about 50%; more preferably, at least about 60%; more preferably, at least about 70%; more preferably, at least about 80%, and more preferably, at least about 90%, based on the total thickness of the multilayer film.

Preferably, the first layer contains one or more polymers having a melt index of from about 0.3 to about 50; more preferably from about 0.5–20; more preferably from about 0.5–10, more preferably from about 0.5–5, more preferably from about 0.5–3, more preferably from about 0.7–2, more preferably from about 0.7–1.5, and more preferably from about 0.7–1.2 (as measured by ASTM D1238; the teaching of which is hereby incorporated, in its entirety, by reference thereto). Preferably, the first component comprises a polymer having a melt index of less than about 5, more preferably, less than about 3; more preferably, less than about 2.5; more preferably, less than about 2.0; more preferably, less than about 1.5, more preferably, less than about 1.3; and more preferably, less than about 1.2. In some embodiments, it is preferable that the first component comprises a polymer having a melt index of less than about 1, more preferably, less than about 0.9.

Preferably, the second component comprises a polymer having a melt index of from about 0.3–50, more preferably from about 0.5–20; more preferably from about 0.5–10, more preferably from about 0.5–5, more preferably from about 0.5–3, more preferably from about 0.7–2, more preferably from about 0.7–1.5, and more preferably from about 0.7–1.2. Preferably, the second component comprises a polymer having a melt index of less than about 5, more preferably, less than about 3; more preferably, less than about 2.5; more preferably, less than about 2.0; more preferably, less than about 1.5, more preferably, less than about 1.3; and more preferably, less than about 1.2. In some embodiments, it is preferable that the second component comprises a polymer having a melt index of less than about 1, more preferably, less than about 0.9.

While the first film could be a monolayer film, preferably, the first film comprises a second layer, in addition to the first layer described above. This second layer preferably comprises at least one member selected from the group consisting of polyolefin, polystyrene, polyamide, polyester, and polyurethane; more preferably, a polyolefin. The second layer preferably comprises at least one member selected from the group consisting of polyethylene homopolymer, polyethylene copolymer, polypropylene homopolymer, polypropylene copolymer, polybutene homopolymer, polybutene copolymer. The polyolefin can be a homogeneous polyolefin or a heterogeneous polyolefin. Preferably, the polyolefin includes at least one member selected from the group consisting of ethylene/alpha-olefin copolymer, ethylene/unsaturated ester copolymer, and ethylene/unsaturated acid copolymer. The preferred ethylene/alpha-olefin copolymers are as described supra in the description of the first layer. However, in a preferred embodiment, the second layer comprises a self-welding polymer, preferably having a melting point of less than 125° C., more preferably less than 110° C., more preferably less than 100° C., more preferably less than 90° C., more preferably less than 85° C., and more preferably less than 80° C. While the second layer could be an inner layer or an outer layer, preferably, the second layer is an inner layer.

The second layer, as described above, preferably has a thickness of from about 0.001 to about 0.2 mm; more preferably, from about 0.003 to about 0.2 mm; more preferably from about 0.005 to about 0.15 mm; more preferably, from about 0.007 to about 0.15 mm; more preferably, from about 0.01 mm to about 0.10 mm; more preferably, from about 0.015 mm to about 0.10 mm; more preferably, from about 0.02 mm to about 0.07 mm; more preferably, from about 0.03 mm to about 0.07 mm; more preferably, from about 0.03 mm to about 0.05 mm. Generally, the thickness of the second layer is from about 1 to about 95% based on the total thickness of the multilayer film; more preferably from about 5 to about 95%; more preferably from about 10 to about 95%; more preferably from about 20 to about 95%, and more preferably from about 25 to about 95%. If the second layer does not comprise an ethylene/alpha-olefin copolymer, preferably it has a thickness of less than 30%, more preferably less than 20%, and more preferably less than 10%, based on total film thickness.

Preferably, the second layer contains at least one polymer having a melt index of from about 0.3 to about 50, as measured by ASTM D1238; the teaching of which is hereby incorporated, in its entirety, by reference thereto; more preferably from about 0.5 to about 20; more preferably from about 0.7 to about 10; even more preferably from about 1 to about 8; and, more preferably from about 1 to about 6.

Optionally, the first film can comprise a third layer, the third layer having a thickness and composition as described above in the description of the second layer. Optionally, the first film can further comprise a fourth layer and/or a fifth layer, these having a thickness and composition as described above in the description of the second layer.

Preferably, the first film has a transverse direction free shrink at 85° C. of at least about 5%; more preferably, at least about 8%, more preferably, at least about 10%; more preferably, at least about 15%; more preferably, at least about 18%; more preferably, at least about 20%; more preferably, at least about 22%; more preferably, at least about 24%; more preferably, at least about 26%; more preferably, at least about 28%; more preferably, at least about 30%; and more preferably, at least about 32%.

Preferably, the first film has a longitudinal direction free shrink at 85° C. of at least 5%; more preferably, at least 8%; more preferably, at least 10%; more preferably, at least 12%; more preferably, at least 14%; more preferably, at least about 16%; more preferably, at least about 18%; more preferably, at least about 20%; and more preferably, at least about 22%.

Preferably, the first film has a total free shrink at 85° C. (i.e., L+T at 85° C.) of at least 5%, more preferably at least 10%, more preferably at least 20%, more preferably at least 25%, more preferably at least 30%, more preferably at least 35%, more preferably at least 40%, more preferably at least 50%, more preferably, at least 52%, more preferably at least 54%, more preferably at least 56%, more preferably at least 58%, and more preferably at least 60%.

The first film of the present invention preferably has a total thickness of from about 0.01 to about 0.25 mm, more preferably from about 0.03 to about 0.20 mm, more preferably from about 0.04 to about 0.18 mm, even more preferably from about 0.06 to about 0.16 mm; more preferably, from about 0.07 to about 0.14 mm; more preferably from about 0.07 to about 0.13 mm; more preferably, from about 0.07 to about 0.12 mm; more preferably, from about 0.07 to about 0.11 mm; and more preferably, from about 0.07 to about 0.10 mm. Preferably, the first film has a thickness of less than about 0.2 mm, more preferably, less than about 0.18 mm; more preferably, less than about 0.16 mm; more preferably, less than about 0.14 mm; more preferably, less than about 0.13 mm; and more preferably, less than about 0.12 mm; and more preferably, less than about 0.11 mm. Preferably, the first film also has a thickness of at least about 0.01 mm; more preferably, at least about 0.03 mm; more preferably, at least about 0.04 mm; more preferably, at least about 0.06 mm; and more preferably, at least about 0.07 mm.

Preferably, the first film according to the present invention comprises a total of from 1 to 20 layers; more preferably, from 1 to 10 layers; more preferably, from 1 to 8 layers; more preferably, from 1 to 6 layers. Preferably, the multilayer film of the invention consists of 1, 2, 3, 4, 5, 6, 7, 8, 9, 10, 11, or 12 layers. While adjacent layers can have identical or similar compositions, preferably, adjacent layers have different compositions.

The first heat-shrinkable film of the present invention can be irradiated and/or corona treated. The term "irradiation" refers to subjecting a film material to radiation such as corona discharge, plasma, flame, ultraviolet, X-ray, gamma ray, beta ray, and high energy electron treatment, any of which can alter the surface of the film and/or induce crosslinking between molecules of the polymers contained therein. The use of ionizing radiation for crosslinking polymers present in a film structure is disclosed in U.S. Pat. No. 4,064,296 (Bornstein et al.), hereby incorporated in its entirety, by reference thereto. Irradiation can produce a cross-linked polymer network and enhances the orientation process used in making the first heat-shrinkable film. In addition, the process of irradiation can improve the impact strength of the first heat-shrinkable film. It has also been discovered that for certain preferred films of this invention, the process of irradiation can improve the total free shrink of the first film, especially at higher dosages. This discovery can be utilized to produce a first heat-shrinkable film which has a total free shrink closer to that of the second heat-shrinkable film, thereby providing good compatibility between the total free shrink of the first film and the second film. This compatibility of total free shrink can provide a superior patch bag exhibiting lower punctures and other leakers. Irradiation can also improve the inter-ply adhesion between the various layers of the first film, if the first film is a multilayer film.

Radiation dosages are referred to herein in terms of the radiation unit "RAD", with one million RADS, also known as a megarad, being designated as "MR", or, in terms of the radiation unit kiloGray (kGy), with 10 kiloGrays representing 1 MR, as known to those of skill in the art. To produce crosslinking, the polymer is subjected to a suitable radiation dosage of high energy electrons, preferably using an electron accelerator, with a dosage level being determined by standard dosimetry methods. A suitable radiation dosage of high energy electrons is in the range of up to about 13–200 kGy, more preferably about 30–175 kGy, more preferably, 50–150 kGy. Preferably, the radiation dosage is at least about 20 kGy; more preferably, at least 40 kGy; more preferably, at least 50 kGy; more preferably, at least 60 kGy; more preferably, at least 70 kGy; more preferably, at least 80 kGy; more preferably, at least 90 kGy; more preferably, at least 100 kGy; more preferably, at least 110 kGy; more preferably, at least 120 kGy; and more preferably, at least 125 kGy. Preferably, the radiation dosage is less than 300 kGy; and more preferably, less than 200 kGy. Preferably, irradiation is carried out by an electron accelerator and the dosage level is determined by standard dosimetry methods. However, other accelerators such as a Van de Graaf or resonating transformer may be used. The radiation is not limited to electrons from an accelerator since any ionizing radiation may be used. A preferred amount of radiation is dependent upon the film and its end use.

Preferably, the difference between the total free shrink of the second film and the total free shrink of the first film, both measured at 85° C. is less than about 60%, 50%, 40%, 35%, 30%, 25%.

Various combinations of layers can be used in the formation of the first heat-shrinkable film according to the invention. Given below are some examples of preferred combinations in which letters are used to represent film layers. Although only 1 through 3-layer embodiments are provided here for illustrative purposes, the multilayer films of the invention also can include more layers, as follows:

"A" represents a first component comprising an ethylene/alpha-olefin copolymer having a density greater than about 0.915 g/cm$^3$, as described in the description of the first component.

"B" represents a second component comprising a heterogeneous ethylene/alpha-olefin copolymer having a density of less than about 0.915 g/cm$^3$, as described in the description of the second component.

"C" represents a polymer comprising at least one member selected from the group consisting of polyolefin, polystyrene, polyamide, polyester, and polyurethane, as described in the description of the second layer.

"X" represents a layer comprising an ethylene/alpha-olefin copolymer having a density greater than about 0.915 g/cm$^3$, as described in the description of the first component.

"Y" represents a layer containing a second component comprising heterogeneous ethylene/alpha-olefin copolymer having a density of less than about 0.915 g/cm$^3$, as described in the description of the second component.

"Z" represents a layer comprising at least one member selected from the group consisting of polyolefin, polystyrene, polyamide, polyester, and polyurethane, as described in the description of the second layer.

The film may be a monolayer film comprising (1) A and B, or (2) A, B, & C. Some preferred two layer films are represented in Table II, below.

TABLE II

| Film # | 1st layer | 2nd layer |
|---|---|---|
| 1 | A | B |
| 2 | A | B + A |
| 3 | A | B + C |
| 4 | A | B + C + A |
| 5 | B | A + B |
| 6 | B | A + C |
| 7 | B | A + B + C |
| 8 | A + B | C |
| 9 | A + B | A + B |
| 10 | A + B | A + C |
| 11 | A + B | B + C |
| 12 | A + C | B + C |
| 13 | B + C | A + B |
| 14 | B + C | A + C |

Some preferred three layer films include: X/Y/X; X/Y/Z; Y/X/Y; Y/X/Z; X/Z/Y; A+B/Z/C; A+C/Z/B; and, B+C/Z/A. In any one of these multilayer structures, a plurality of layers may be formed of the same or different modified compositions and one or more tie-layers added.

EXAMPLES

The identity of the resins utilized in Examples 1–11 is as follows:

TABLE III

| Resin Code | Commercial Name | Melt Index | Density (gm/cm$^3$) | Comonomer Type/ Comonomer Content | Manufacturer |
|---|---|---|---|---|---|
| VLDPE No. 1 | ATTANE ® 4203 | 0.8 | 0.905 | 11.5%/$C_8$ | Dow |
| LLDPE No. 1 | DOWLEX ® 2045.03 | 1.1 | 0.920 | 6.5%/$C_8$ | Dow |
| LLDPE No. 2 | SCLAIR ® 11C1 | 0.8 | 0.918 | — | Nova Chemicals |
| EVA No. 1 | ESCORENE ® LD318.92 | 2.0 | 0.930 | Vinyl acetate/9% | Exxon Chemical Company |
| EVA No. 2 | ESCORENE ® LD761.36 | 5.7 | 0.950 | Vinyl acetate/ 28% | Exxon Chemical Company |
| Additive No. 1 | L-710-AB (antiblock & UV fluorescence additive | 4.5 | 0.945 | N/A | Bayshore Industrial, Inc. |
| HEAO No. 1 | AFFINITY ® DPF 1150.01 | 0.9 | 0.900 | $C_8$/12.5% | Dow |

Example 1

Patch Film No. 1 (Comparative)

A coextruded, two-ply tubular tape was cast, having a thickness of about 17 mils, containing an "A Layer" making up 82 percent of the tape thickness and a "B Layer" making up 18 percent of the tape thickness. The A Layer was composed of a blend of 87 weight percent VLDPE No. 1, 10 weight percent EVA No. 1, and 3 weight percent Additive Package No. 1. The B Layer was composed of 100% EVA No. 2. The two-ply tubing was cooled to a solid phase in a water bath, and electronically crosslinked with an exposure level of 90 to 110 kilograys (kGy).

The resulting crosslinked two-ply tubing was heated by hot water at 205–212° F. and subsequently oriented by being drawn and stretched approximately 300 to 330 percent, in each of the machine and transverse directions respectively, using a trapped bubble of air held between two sets of nip rolls. The orientation produced a 2.25 mil thick two-ply film in the form of a tube.

TABLE IV

| Layer Designation | Layer Function | Layer Chemical Identity | Layer Thickness (mils) |
|---|---|---|---|
| A | Outside, Puncture Resistant | 87% VLDPE No. 1<br>10% EVA No. 1<br>3% Additive Pkg. No. 1 | 1.84 |
| B | Interior Tie | 100% EVA No. 2 | 0.41 |

Film No. 1 was determined to have free shrink at 185° F. (via ASTM 2732) and an instrumented impact (via ASTM D3763) as set forth in Table VIII below.

An alternative to Patch Film No. 1 is a two-layer film with thickness of about 2.25 mils, with about 82 percent of the film thickness being the A Layer, and about 18 percent of the film thickness being the B Layer, which was the inside layer of the 2-ply tubing. This film could be produced using a flat die, rather than a circular die, followed by cooling, crosslinking, heating, and orientation.

Example 2

Patch Film No. 2

Patch Film No. 2 was prepared by the same processes employed to make Patch Film No. 2, with the exception that in Patch Film No. 2, the A Layer was composed of a blend of 43.5 weight percent LLDPE No. 1, 43.5 weight percent VLDPE No. 1, 10 weight percent EVA No. 1, and 3 percent Additive Package No. 1. The B Layer, which was the inside layer of the 2-ply tubing, was identical to the B Layer in Patch Film No. 1. Also in Patch Film No. 2, the A Layer made up 82 weight percent of the tape thickness and the B Layer made up 18 percent of the tape thickness. Patch Film No. 2 free shrink and instrumented impact results are shown in Table VIII, below.

Example 3

Patch Film No. 3 (Comparative)

Patch Film No. 3 was prepared by the same processes employed to make Patch Film No. 1, with the exception that in Patch Film No. 3, the A Layer was composed of a blend of 87 weight percent LLDPE No. 1, 10 weight percent EVA No. 1, and 3 weight percent Additive Package No. 1. The B Layer was identical to B Layer in Patch Film No. 1, and was the inside layer of the two-ply tubing. Also in Patch Film No. 3, the A Layer made up 82 percent of the tape thickness, and the B Layer made up 18 percent of the tape thickness. Free shrink and instrumented impact results for Patch Film No. 3 are provided in Table VIII below. Patch Film No. 3 was a comparative as it did not contain VLDPE.

TABLE V

| Film No. | Free Shrink @ 185° F. (%) | Impact Peak Load (N) | Indexed Peak Load (N/mil) | Impact Energy to Break (J) | Indexed Impact Energy (J/mil) | Thickness (mil) | Composition Providing Impact (% in outer layer) |
|---|---|---|---|---|---|---|---|
| 1 | 75 | 159 | 60 | 2.2 | 0.83 | 2.64 | 87% VLDPE #1<br>10% EVA #1 |
| 2 | 61 | 192 | 71 | 3.0 | 1.11 | 2.71 | 43.5% VLDPE #1<br>43.5% LLDPE #1<br>10% EVA #1 |
| 3 | 49 | 195 | 78 | 2.9 | 1.16 | 2.50 | 87% LLDPE #1<br>10% EVA #1 |

Patch Film No. 4

A coextruded, two-ply tubular tape was cast, having a thickness of about 26 mils, the tape having an A Layer making up 85 percent of the tape thickness and a B Layer making up 15 percent of the tape thickness. The A Layer was composed of 75 weight percent VLDPE No. 1, 20.5 weight percent LLDPE No. 2, and 4.5 weight percent Additive Package No. 1. The B Layer, which was the inside layer of the two-ply tubing, was composed of 100 weight percent EVA No. 2. The two-ply tubing was cooled to a solid phase in a water bath, and electronically crosslinked with a 500 keV beam to a level from about 90–110 kGy.

The resulting crosslinked two-ply tubing was heated by steam at about 220 to 226° F. and then by hot air at about 270 to 275° F. Subsequently, orientation was performed by drawing and stretching to approximately 320 to 400 percent in each of the machine and transverse directions respectively, using a trapped bubble of air held between two sets of nip rolls. The orientation produced a 2.25 mil two-ply film in the form of a tube.

After orientation, the resulting tube of heat-shrinkable lay-flat tubing was passed through a pair of heated nip rolls, causing the internal B Layer to bond to itself as the tube was collapsed, in accordance with U.S. Pat. No. 4,765,857, to Ferguson, the entirety of which is hereby incorporated by reference thereto. This rendered a four-ply film, with the middle plies being the inside B layer of the tubing bonded to itself The resulting film had a nominal thickness of 4.5 mils. Patch Film No. 4 was composed of the above three layers, the middle layer being composed of the inside layer of the tubing. Patch Film No. 4 was determined to have free shrink at 185° F. (via ASTM 2732) and an instrumented impact (via ASTM D3763) as set forth in Table VIII below. The composition of Patch Film No. 4 is set forth in Table VI, below.

TABLE VI

| Layer Designation | Layer Function | Layer Chemical Identity | Layer Thickness (mils) |
|---|---|---|---|
| A | Outside, Puncture-Resistant | 75% VLDPE No. 1<br>20.5% LLDPE No. 2<br>4.5% Additive Pkg. No. 1 | 1.91 |
| B | Inner, tie and self-weld | 100% EVA No. 2 | 0.34 |

An alternative to Patch Film No. 4 is a two-ply flat film (i.e., non-annular film) with thickness of about 4.5 mils, with about 82 percent of the film composed of A Layer and about 18 percent of the film composed of B Layer. This film could be produced using a flat die, rather than a circular die, followed by cooling, crosslinking, heating, and orientation.

Patch Film No. 5 (Comparative)

Patch Film No. 5 was prepared by the same processes employed to make Patch Film No. 4, with the exception that in Patch Film No. 5, the A Layer was composed of 95.5 weight percent VLDPE No. 1 and 4.5 weight percent of Additive Package No. 1. The B Layer was identical to the B Layer in Patch Film No. 4. Also in Patch Film No. 5, the A Layer made up 85 percent of the tape thickness, while the B Layer, which was the inside layer of the tubing, made up the remaining 15 percent of the tape thickness. The Patch Film No. 5 free shrink, instrumented impact, and Standard Covered Bone Puncture Bag Drop Test results are set forth below in Table VIII.

Patch Film No. 6 (Comparative)

Patch Film No. 6 was prepared by the same processes employed to make Patch Film No. 4, with the exception that in Patch Film No. 6, the A Layer was composed of 95.5 weight percent LLDPE No. 2 and 4.5 weight percent of Additive Package No. 1. The B Layer was identical to the B Layer in Patch Film No. 4. Also in Patch Film No. 6, the A Layer made up 85 percent of the tape thickness, while the B Layer, which was the inside layer of the tubing, made up the remaining 15 percent of the tape thickness. The Patch Film No. 6 free shrink, instrumented impact, and Standard Covered Bone Puncture Bag Drop Test results are set forth below in Table VIII. Patch Film No. 6 is a comparative patch film because it does not contain any VLDPE.

Patch Film No. 7 (Comparative)

Patch Film No. 7 was prepared by the same processes employed to make Patch Film No. 4, with the exception that Patch Film No. 7 was composed of five layers having a C/A/B//B/A/C. The C Layer was composed of 75 weight percent VLDPE No. 1, 20.5 weight percent LLDPE No. 2, and 4.5 weight percent of Additive Package No. 1. The B Layer was identical to the B Layer in Patch Film No. 4. The A Layer was composed of 50 weight percent homogeneous ethylene/alpha-olefin No. 1 ("HEAO No. 1"), 45.5 weight percent LLDPE No. 2, and 4.5 weight percent Additive Package No. 1. Also in Patch Film No. 7, the A Layer made up 60 percent of the tape thickness, the B Layer made up 15 percent of the tape thickness, and layer C made up 25 percent of the tape thickness.

TABLE VII

| Layer Designation | Layer Function | Layer Chemical Identity | Layer Thickness (mils) |
|---|---|---|---|
| C | Outside, Puncture-Resistant | 75% VLDPE No. 1<br>20.5% LLDPE No. 2<br>4.5% Additive Pkg. No. 1 | 0.56 |
| B | Interior Tie and Self Weld | 100% EVA No. 2 | 0.34 |
| A | Inner, Puncture-Resistant | 50% HEAO No. 1<br>45.5% LLDPE NO. 2<br>4.5% Additive Pkg. No. 1 | 1.35 |

The Patch Film No. 7 free shrink, instrumented impact, and Standard Covered Bone Puncture Bag Drop Test results are shown in Table VIII, below. Patch Film No. 7 is a comparative patch film because the majority layer was made up of a blend of 50 weight percent homogeneous ethylene/alpha olefin copolymer and 45.5 weight percent LLDPE.

TABLE VIII

| Film # | Free Shrink @ 185° F. (%) | Impact Peak Load (N) | Indexed Peak Load (N/mil) | Impact Energy to Break (J) | Indexed Energy to Break (J/mil) | Thickness (mil) | Standard Rib Drop Test[1] (%); (n = 96) | Composition of Majority Layer |
|---|---|---|---|---|---|---|---|---|
| 4 | 55 | 530 | 98 | 9.4 | 1.74 | 5.4 | 25 | Blend of VLDPE & LLDPE |
| 5 | 57 | 527 | 98 | 9.5 | 1.75 | 5.4 | 33.3 | VLDPE |
| 6 | 28 | 455 | 101 | 6.3 | 1.40 | 4.5 | 37.5 | LLDPE |
| 7 | 48 | 482 | 93 | 8.0 | 1.54 | 5.2 | 43.8 | Blend of HEAO & LLDPE |

The Standard Rib Drop Test

The Standard Rib Drop Test was carried out as follows. Two pieces of split beef back-ribs (total package weight of from 4 to 5 pounds) were placed in a 7 inch wide, 24 inch long end-seal patch bag termed a "wide-patch bag" due to the fact that the patches extend past the side edges of the bag. The bag film was as set forth in Table 1, above, and had a thickness of 2.4 mils. Only the patch film varied with the test being conducted. The patch bag had a patch adhered to each lay-flat side thereof, with each of the patches having a length of 19 inches and a width of 8½ inches. The lower edge of the patches was positioned approximately 5/16 inch above the end-seal of the bag. The patches extended past the bag side edges, with the overhanging portions of the patches being adhered to one another. The uppermost 4 11/16 inches of the bag was not covered by a patch on either lay-flat side thereof. The patch bag, having the two split beef back ribs therein, was placed in a Cryovac® Model 8600B-18 rotary chamber vacuum packaging machine, which evacuated the air from the bag and sealed the bag shut, and trimmed off the excess bag length. The resulting package was then run through a Cryovac® Model 6570E hot water shrink tunnel in which the water temperature was 200° F. The bag shrunk tight to the product as a result of passing through the shrink tunnel.

The test data was generated as follows. Six different patch formulations were tested to determine puncture resistance in actual use. The patch bags for each of the formulations were tested with six different sets of split beef back ribs, with 16 ribs per set. For the first rib set, the first patch bag formulation was tested by packaging the ribs in pairs in each of eight patch bags of a first formulation. The packages were evacuated, sealed, and excess length removed, as described above. Then, each evacuated package was placed on edge, i.e., rib ends down (the most vulnerable position), in a 400 mm wide by 600 mm long by 235 mm high cardboard box made by Weyerhauser, of Amarillo, Tex., the box being of a type known as XB3-07046. The box, having the eight packages therein, each with rib ends down, was dropped one time from a height of 3 feet, using an Accu Drop® 130 drop tester, produced by M.T. Lab, Lab Division, of Onondaga Street, Skaneateles, New York, 13152. The packages were then removed from the box and inflated with air while submerged, to determine if the patch was punctured. The total number of packages with punctured patches (i.e., leakers) were recorded for the set of eight packages tested.

[1] Bone Puncture was measured according to the Standard Covered Bone Puncture Bag Drop Test described above.

The ribs in the bags tested were then removed from the tested bags and loaded into a second set of eight patch bags, each being of the second patch formulation, which of course differed from the first patch formulation. The test was then repeated in the same manner in which the first set of patch bags was tested, i.e., as described above; again for a third set of patch bags, and so on, until all 6 different sets of patch bags had been tested with the same set of split beef back ribs. A total of 48 bags were dropped to generate this data set.

However, since the ribs, at least in theory, could have been dulled by repetitive drops, repetitive testing was structured to allow each set of patch bags to be the first set tested with a fresh set of ribs, the second set tested, and so on. In order to carry this out, a second data set was generated in a manner identical to the generation of the first data set, except that the second patch bag formulation was the first tested, etc, with the first formulation being the last tested in the set, and the order of testing otherwise being the same. Then yet a third data set was generated with the third patch bag formulation being the first tested, etc, up through six different data sets, with each patch bag formulation being the first tested with a particular set of ribs, the second tested, etc. In this manner, each set of patch bags was subjected to a total puncture abuse which was, in theory, equivalent to the other sets of patch bags tested. Then, after the six data sets were generated as a first "data grid," the entire data grid was repeated with the same ribs, in the same order as the first data grid. In total, 576 data points were generated, with each patch bag formulation being dropped to produce a total of 96 data points, including data from both grids.

Surprisingly, the bone-puncture-resistance of the film containing the VLDPE/LLDPE blend was greater than if either VLDPE alone or LLDPE alone are present as the bone-puncture-resistant polymer. Compare the Standard Rib Drop Test result for Example 4 versus Examples 5, 6, and 7. Moreover, the patch film comprising the VLDPE-LLDPE blend, if substantially free of ethylene/vinyl acetate copolymer and/or homogeneous ethylene/alpha-olefin copolymer, i.e., preferably no more than 30 percent of these polymers (more preferably, no more than 25, 20, 15, 10, 5, 0), provided the patch with a greater bone-puncture-resistance while also providing relatively high free shrink at, for example 85° C. That is, even if the patch is made from a blend of VLDPE and LLDPE, if substantial amounts of ethylene/vinyl acetate copolymer and/or homogeneous ethylene/alpha-olefin copolymer are present in the patch film, the bone-puncture-resistance is lowered. Preferably, the heat-shrinkable patch film comprises a VLDPE-LLDPE blend, with no EVA or homogeneous ethylene/alpha-olefin copolymer present in the patch film.

Patch Film No. 8 (Comparative)

A coextruded, two-ply tubular tape was cast, having a thickness of about 26 mils, the tape having an A Layer making up 85% of the tape thickness and a B Layer making up 15% of the tape thickness. The A Layer was composed of 97% LLDPE No. 2 and 3 percent Additive No. 1. The B Layer was composed of 100% EVA No. 2. The two-ply tubing was cooled to a solid phase in a water bath, and electronically crosslinked with a 500 keV beam to a level of about 90–110 kGy.

The resulting crosslinked two-ply tubing was heated by steam at about 220 to 226° F., followed by being heated by hot air at about 270° F. to 275° F. Subsequently, orienting was performed by drawing and stretching approximately 320–400%, in each of the machine and transverse directions respectively, using a trapped bubble of air held between two sets of nip rolls. The orientation produced a nominally 2.25 mil two-ply film in the form of a tube.

After orientation, the resulting tube of heat shrinkable flat film was passed through a pair of heated nip rolls, causing the internal B Layer to bond to itself as the tube was collapsed. This rendered a four-ply film, with the middle plies being the inside B Layer bonded to itself The resulting film had a nominal thickness of 4.5 mils. The composition of Film No. 8 was as set forth in Table IX, below.

TABLE IX

| Layer Designation | Layer Function | Layer Chemical Identity | Layer Thickness (mils) |
|---|---|---|---|
| A | Outside, Puncture-Resistant | 97% LLDPE No. 2<br>3% Additive Pkg. No. 1 | 1.91 |
| B | Interior Tie | 100% EVA No. 2 | 0.34 |

Patch Film No. 8 was composed of the above three layers, the middle layer being composed of the inside tube layer adhered to itself Patch Film No. 8 was determined to have free shrink at 185° F. (via ASTM 2732) and an instrumented impact (via ASTM D3763) as set forth in Table X below.

An alternative to Patch Film No. 8 is a two-layer film with thickness of about 4.5 mils, with about 85% of the film composed of the A Layer and about 15% of the film composed of the B Layer. This film could be produced using a flat die, rather than a circular die, followed by cooling, crosslinking, heating, and orientation.

Patch Film No. 9

Patch Film No. 9 was prepared by the same processes employed in Patch Film No. 8, with the exception that in Patch Film No. 9, the A Layer was composed of a blend of 50 weight percent VLDPE No. 1 and 47 weight percent of LLDPE No. 2, and 3 weight percent of Additive Package No. 1. The B Layer was identical to the B Layer in Patch Film No. 8. Also, in Patch Film No. 9 the A Layer made up 85 percent of the tape thickness and the B Layer made up 15 percent of the tape thickness. The free shrink and instrumented impact for Patch Film No. 9 are shown in Table X, below.

Patch Film No. 10

Patch Film No. 10 was prepared by the same processes employed in Patch Film No. 4, with the exception that in Patch Film No. 10, the A Layer was composed of a blend of 75 weight percent VLDPE No. 1 and 23 weight percent of LLDPE No. 2, and 3 weight percent of Additive Package No. 1. The B Layer was identical to the B Layer in Patch Film No. 8. Also, in Patch Film No. 10 the A Layer made up 85 percent of the tape thickness and the B Layer made up 15 percent of the tape thickness. The free shrink and instrumented impact for Patch Film No. 10 are shown in Table X, below.

Patch Film No. 11 (Comparative)

Patch Film No. 11 was prepared by the same processes employed in Patch Film No. 8, with the exception that in Patch Film No. 11, the A Layer was composed of a blend of 97 weight percent VLDPE No. 1 and 3 weight percent of Additive Package No. 1. The B Layer was identical to the B Layer in Patch Film No. 8. Also, in Patch Film No. 11 the A Layer made up 85 percent of the tape thickness and the B Layer made up 15 percent of the tape thickness. The free shrink and instrumented impact for Patch Film No. 11 are shown in Table X, below.

TABLE X

| Patch Film No. | Total Free Shrink @ 185° F. (%) | Impact Peak Load (N) | Indexed Peak Load (N/mil) | Impact Energy to Break (J) | Indexed Energy to Break (J/mil) | Thick-ness (mil) | Composition of Majority Layer |
|---|---|---|---|---|---|---|---|
| 8 (Comparative) | 33 | 513 | 112 | 6.7 | 1.46 | 4.6 | 97% LLDPE No. 2 |
| 9 (Invention) | 36 | 529 | 110 | 8.1 | 1.69 | 4.8 | Blend of 50% VLDPE No. 1 And 47% LLDPE No. 2 |
| 10 (Invention) | 44 | 509 | 106 | 8.0 | 1.67 | 4.8 | Blend of 75% VLDPE No. 1 And 23% LLDPE No. 2 |
| 11 (Comparative) | 48 | 479 | 100 | 7.5 | 1.56 | 4.8 | 97% VLDPE No. 1 |

Examples 8–11 demonstrate that films for use in patches, in accordance with the present invention, exhibit increased energy to break relative to various comparative films designed for use in patches. Increased energy to break is associated with improved performance in a Standard Rib Drop Test.

The data from the various examples above indicates that the films of this invention (e.g., the films of Examples 2, 4, 9, and 10) have an impact energy which is comparable or superior to the impact energy of various films of the prior art.

It has been discovered that a mix of a high crystallinity ethylene/alpha-olefin copolymer and a low crystallinity heterogeneous ethylene/alpha-olefin copolymer is advantageous for use in a heat-shrinkable patch film adhered to a heat-shrinkable bag film. While the high crystallinity ethylene/alpha-olefin copolymer provides enhanced stiffness (i.e., enhanced modulus) and enhanced abrasion-resistance, it is difficult to stretch films dominated by highly crystalline polymers. The low crystallinity polymer provides enhanced elongation (i.e., is easier to stretch, especially at relatively low solid-state orientation temperatures), as well as providing greater puncture-resistance than high crystallinity ethylene/alpha-olefin copolymers.

Importantly, the combination of a high crystallinity ethylene/alpha-olefin copolymer and the low crystallinity heterogeneous ethylene/alpha-olefin copolymer can, in conjunction with crosslinking, be used to optimize the tie-chain concentration, providing an enhanced combination of properties, such as the combination of impact-resistance, puncture-resistance, and abrasion-resistance. Additionally, it is believed that the combination of high crystallinity ethylene/alpha-olefin copolymer and low crystallinity heterogeneous ethylene/alpha-olefin copolymer can provide better impact strength at low temperatures, because of the presence of the low crystallinity polymer in the film. The incorporation of the higher crystallinity component provides enhanced abrasion resistance, especially on the outer surface of the film.

In prior art commercial patch bags, the domination of the patch film by the high crystallinity ethylene/alpha-olefin copolymer has impeded the ability to obtain high abrasion-resistance in combination with high free shrink, because the high density, high crystallinity ethylene/alpha-olefin copolymers (especially those at and above 0.92) have forced the patch film to have a lower total free shrink at 185° F. than has been desired. As a result, the total free shrink of the patch has been significantly less than the total free shrink of the bag to which the film has been adhered. As a result, the total free shrink of patch-bag laminate has been lower than has been desired. The lower shrinkage of such a patch bag adversely affects the appearance of the resulting packaged product. More particularly, the highly crystalline LLDPE in the patch film renders such films more difficult to orient.

However, it has been discovered that this drawback can be reduced or eliminated by providing the patch with a low crystallinity heterogeneous ethylene/alpha-olefin copolymer to facilitate the orientation of the film. If the low crystallinity polymer is an ethylene/alpha-olefin copolymer, it should be a heterogeneous ethylene/alpha-olefin copolymer because the broader molecular weight distribution of such copolymers provides the film with an abrasion-resistance and an impact-resistance which is higher than if the low crystallinity polymer is a homogeneous ethylene/alpha-olefin copolymer. Furthermore, the heterogeneous ethylene/alpha-olefin copolymer provides higher free shrink. Compare Examples 4 and 7, above. As can be seen, the use of heterogeneous ethylene/alpha-olefin copolymer with a density of at less than 0.915 provides superior impact strength, as measured by indexed energy to break, and superior performance in the Standard Rib Drop Test. This is quite unexpected.

Finally, by providing the patch film with a total of the high crystallinity ethylene/alpha-olefin copolymer and the low crystallinity heterogeneous ethylene/alpha-olefin copolymer in an amount of at least 70 percent, based on total film weight, the film is provided with enhanced impact-resistance and abrasion-resistance properties, relative to films which contain other components, such as ethylene/vinyl acetate copolymer, in an amount greater than 30 percent, based on total film weight.

Although in general the bag according to the present invention can be used in the packaging of any product, the bag of the present invention is especially advantageous for the packaging of food products, especially fresh meat products comprising bone, especially cut bone ends present at or near the surface of the fresh meat product. Preferably, the meat product comprises at least one member selected from the group consisting of poultry, pork, beef, lamb, goat, horse, and fish. More preferably, the meat product comprises at least one member selected from the group consisting of ham, sparerib, picnic, back rib, short loin, short rib, whole turkey, and pork loin. Still more preferably, the meat product comprises bone-in ham, including both smoked and processed ham, fresh bone-in ham, turkey, chicken, and beef shank. Ribs are a particularly preferred cut for packaging in the patch bag of the present invention.

Although the present invention has been described in connection with the preferred embodiments, it is to be understood that modifications and variations may be utilized without departing from the principles and scope of the invention, as those skilled in the art will readily understand. Accordingly, such modifications may be practiced within the scope of the following claims.

What is claimed is:

1. A patch bag comprising a heat-shrinkable patch adhered to a heat-shrinkable bag, the heat-shrinkable patch comprising a first heat-shrinkable film and the heat-shrinkable bag comprising a second heat-shrinkable film, the first heat-shrinkable film comprising a blend of:

A) ethylene/alpha-olefin copolymer having a density greater than about 0.915 g/cm$^3$ in an amount of at least about 5 percent, based on a total weight of the blend; and B) heterogeneous ethylene/alpha-olefin copolymer having a density of less than about 0.915 g/cm$^3$, present in an amount of at least about 21 percent, based on the total weight of the blend; and wherein the ethylene/alpha-olefin copolymer having a density greater than about 0.915 g/cm$^3$ and heterogeneous ethylene/alpha-olefin copolymer having a density of less than about 0.915 g/cm$^3$ together make up at least 70 percent of the total weight of the first film, and wherein the patch is adhered to the bag with an adhesive or corona treatment.

2. The patch bag according to claim 1, wherein the ethylene/alpha-olefin copolymer having a density greater than about 0.915 g/cm$^3$ is present in the blend in an amount of from about 5 to 70 percent, based on the weight of the blend, and the heterogeneous ethylene/alpha-olefin copolymer having a density of less than about 0.915 g/cm$^3$ is present in the blend in an amount of from about 30 to 95 percent, based on the weight of the blend.

3. The patch bag according to claim 2, wherein both the first and second heat-shrinkable films each have a total free shrink, at 185° F., of at least 35 percent, and the ethylene/alpha-olefin copolymer having a density greater than about 0.915 g/cm$^3$ comprises linear low density polyethylene in an amount of from about 20 to 50 percent, based on total blend weight, and the heterogeneous ethylene/alpha-olefin copolymer having a density of less than about 0.915 g/cm$^3$ comprises very low density polyethylene in an amount of from about 50 to 80 weight percent, based on total blend weight, with the blend optionally comprising a homogeneous ethylene/alpha-olefin copolymer having a density of from about 0.88 to 0.915 g/cm$^3$ in an amount of from about 0 to 30 percent, based on total blend weight, with the blend being present in an amount of at least 70 weight percent, based on layer weight, in a layer having a thickness of at least about 0.6 mil.

4. The patch bag according to claim 2, wherein the blend comprises very low density polyethylene in an amount of from about 60 to 95 weight percent, based on total blend weight, and linear low density polyethylene in an amount of from about 5 to 40 percent.

5. The patch bag according to claim 2, wherein the blend comprises at least 75 percent of the patch, based on total patch weight.

6. The patch bag according to claim 2, wherein the patch bag exhibits a Standard Rib Drop Test failure rate of less than 35 percent.

7. The patch bag according to claim 2, wherein the patch is free of homogeneous ethylene/alpha-olefin copolymer.

8. The patch bag according to claim 2, wherein the blend comprises homogeneous ethylene/alpha-olefin copolymer in an amount of from about 1 to about 20 percent, based on blend weight.

9. The patch bag according to claim 2, wherein the blend further comprises up to 15 weight percent of at least one member selected from the group consisting of slip, filler, pigment, dye, radiation stabilizer, antioxidant, fluorescence additive, antistatic agent, elastomer, and viscosity-modifying agent.

10. The patch bag according to claim 2, wherein the patch comprises very low density polyethylene in an amount of from about 70 to 80 weight percent, and linear low density polyethylene in an amount of from about 20 to 30 weight percent.

11. The patch bag according to claim 2, wherein the patch is a monolayer film.

12. The patch bag according to claim 2, wherein the bag comprises a first biaxially-oriented, heat-shrinkable film comprising an outside abuse layer, an inner $O_2$-barrier layer, and an inside-sealant layer, and the patch comprises a second biaxially-oriented, heat-shrinkable film.

13. The patch bag according to claim 2, wherein the patch is adhered to an outside surface of the bag.

14. The patch bag according to claim 2, wherein the first heat-shrinkable film has an indexed energy to break of at least 0.6 Joules per mil.

15. The patch bag according to claim 2, wherein the patch is a multilayer film.

16. The patch bag according to claim 15, wherein the patch film comprises outer layers each of which comprises the blend, and an inner layer comprising at least one member selected from the group consisting of ethylene/unsaturated ester copolymer, homogeneous ethylene/alpha-olefin copolymer, ethylene/unsaturated acid copolymer, and ionomer.

17. The patch bag according to claim 15, wherein the multilayer film comprises an inner layer welded to itself and outer layers each comprising the blend.

18. The patch bag according to claim 17, wherein the inner layer welded to itself comprises ethylene/vinyl acetate copolymer in an amount of at least 50 percent, based on the weight of the inner layer.

19. The patch bag according to claim 18, wherein the ethylene/vinyl acetate copolymer comprises vinyl acetate in an amount of from about 3 to 50 weight percent, based on the weight of the ethylene/vinyl acetate copolymer.

20. The patch bag according to claim 15, wherein the multilayer film comprises at least two layers which comprise the blend.

21. The patch bag according to claim 15, wherein the multilayer film has a symmetrical cross-section.

22. The patch bag according to claim 21, wherein the multilayer film comprises an inner layer comprising ethylene/vinyl acetate in an amount of from about 50 to 100 percent, and the film further comprises two outer layers, each of which contains the blend.

23. The patch bag according to claim 22, wherein the blend comprises very low density polyethylene in an amount of from about 70 to 80 percent and linear low density polyethylene in an amount of from about 20 to 30 percent.

24. The patch bag according to claim 23, wherein the patch further comprises an intermediate layer which also comprises the blend.

25. The patch bag according to claim 1, wherein the first heat-shrinkable film has a total free shrink at 85° C. of at least 35 percent.

26. The patch bag according to claim 1, wherein the first heat-shrinkable film has a total free shrink at 85° C. of at least 40 percent.

27. The patch bag according to claim 1, wherein the first heat-shrinkable film has a total free shrink at 85° C. of at least 50 percent.

28. The patch bag according to claim 1, wherein the first heat-shrinkable film has a total free shrink at 85° C. of at least 60 percent.

29. A patch bag comprising a heat-shrinkable patch adhered to a heat-shrinkable bag, the heat-shrinkable patch comprising a first heat-shrinkable film and the heat-shrinkable bag comprising a second heat-shrinkable film, the first heat-shrinkable film comprising a blend of:

A) ethylene/alpha-olefin copolymer having a density greater than about 0.915 g/cm$^3$, present in an amount of at least about 5 percent based on a total weight of the blend; and B) heterogeneous ethylene/alpha-olefin copolymer having a density of less than about 0.915 g/cm$^3$ and a composition distribution breadth index less than 55 percent, present in an amount of at least about 21 percent, based on the total weight of the blend; and wherein the ethylene/alpha-olefin copolymer having a density greater than about 0.915 g/cm$^3$ and heterogeneous ethylene/alpha-olefin copolymer having a density of less than about 0.915 g/cm$^3$ together make up at least 70 percent of the total weight of the first film, and wherein the patch is adhered to the bag with an adhesive or corona treatment.

* * * * *